US006244700B1

(12) United States Patent
Kimura et al.

(10) Patent No.: US 6,244,700 B1
(45) Date of Patent: Jun. 12, 2001

(54) INK JET RECORDING APPARATUS AND A FIXING HEATER USED FOR SUCH APPARATUS

(75) Inventors: Isao Kimura, Kawasaki; Hiroshi Sugitani, Machida; Yasuhiro Yano, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/045,687

(22) Filed: Mar. 23, 1998

(30) Foreign Application Priority Data

Mar. 25, 1997 (JP) ..... 9-071638
Mar. 16, 1998 (JP) ..... 10-065215

(51) Int. Cl.[7] ..... B41J 2/01
(52) U.S. Cl. ..... 347/102
(58) Field of Search ..... 347/101, 102, 347/156, 17; 399/336; 219/216; 101/488

(56) References Cited

U.S. PATENT DOCUMENTS

| | | | | |
|---|---|---|---|---|
| 4,517,893 | * | 5/1985 | Wile et al. | 101/123 |
| 4,978,969 | * | 12/1990 | Chieng | 347/102 |
| 5,020,244 | | 6/1991 | Smith | 34/155 |
| 5,132,519 | | 7/1992 | Jackson et al. | 219/388 |
| 5,428,384 | | 6/1995 | Richtsmeier et al. | 347/102 |
| 5,479,199 | | 12/1995 | Moore et al. | 347/102 |
| 5,668,584 | * | 9/1997 | Broder et al. | 347/102 |
| 5,754,208 | * | 5/1998 | Szlucha | 347/102 |
| 5,896,154 | * | 4/1999 | Mitani et al. | 347/102 |

FOREIGN PATENT DOCUMENTS

| | | |
|---|---|---|
| 26 00 832 A1 | 7/1977 | (DE) . |
| 0 213 855 A2 | 3/1987 | (EP) . |
| 0 284 215 A1 | 9/1988 | (EP) . |
| 2 141 072 | 12/1984 | (GB) . |
| 57-120447 | 7/1982 | (JP) . |
| 2-182461 | 7/1990 | (JP) . |
| 5-338126 | 12/1993 | (JP) . |
| 7-195683 | 8/1995 | (JP) . |
| 7-314661 | 12/1995 | (JP) . |
| 8-258254 | 10/1996 | (JP) . |

OTHER PUBLICATIONS

Patent Abstracts of Japan, vol. 014, No. 454 (M–1031), Sep. 28, 1990 (with respect to JP 2–182461 of Jul. 17, 1990).

Patent Abstracts of Japan, vol. 009, No. 114 (M–380), May 18, 1985 (with respect to JP 60–964 of Jan. 7, 1985).

* cited by examiner

*Primary Examiner*—Robert Beatty
(74) *Attorney, Agent, or Firm*—Fitzpatrick, Cella, Harper & Scinto

(57) ABSTRACT

An ink jet recording apparatus for recording by discharging recording liquid droplets from the discharge openings to a recording material for the adhesion of the liquid droplets on the recording material for the formation of images includes a carrier path for carrying the recording material, and heating device arranged in the carrier path to heat the recording material and recording liquid. This heating device is provided with a heater that radiates infrared radiation having a maximum radiation ratio $\epsilon$ with a peak wavelength range of 4–10 $\mu$m. A supporting member for supporting the recording material where it is heated by the heating device has a surface having a radiation ratio of not more than 0.1. As a result, the quality of recorded images is enhanced and the power dissipation is made lower to enable the capacitance of the power supply to be smaller.

63 Claims, 12 Drawing Sheets

INK JET RECORDING APPARATUS AND A FIXING HEATER USED FOR SUCH APPARATUS

BACKGROUND OF THE INVENTION

1. Field of the Invention

The present invention relates to an ink jet recording apparatus for recording images by discharging recording liquid (ink) droplets from the recording head for its adhesion to a recording material. The invention also relates to a fixing heater to be used for such apparatus.

2. Related Background Art

An ink jet recording apparatus is utilized for a printer, a copying machine, a facsimile machine, a textile printer, and a plotter, among some others. The ink jet recording apparatus has a number of advantages in that it can print at high speeds even on an ordinary paper sheet, and that it can easily print in color. Therefore, the ink jet recording apparatus has been in use widely and increasingly along with the higher speed processing made available by use of personal computers in recent years.

Meanwhile, ink absorbing speed is slower for recording on an ordinary paper sheet than on a specially treated paper whose ink absorption is made faster. As a result, image unevenness tends to take place due to the non-uniformity of the recording surface of ordinary paper sheets. Also, the ordinary paper sheets are supplied by paper manufacturing companies in various places in the world. Therefore, the absorption of ink varies greatly by the variations of materials and methods of manufacture. Particularly, when color images are recorded, the amount of ink to be used is greater than that for a monochromatic recording, which requires a longer time for fixation. For improved recording on an ordinary paper sheet, it should be an effective means if the fixation of ink is promoted by the application of heat to the recording sheet. As the so-called "heating fixation" techniques where a recording material and recording liquid are heated for fixation, there have been developed, among some others, a hot plate heating method wherein a recording material is allowed to be in contact with a hot plate, a hot air method where hot air is blown onto recording liquid, a radiation heating method where a recording material is heated by the application of radiant heat using an infrared lamp, an infrared heater, or the like. For these conventional arts, a number of methods are proposed in which each of the heat fixation methods described above is used individually. However, along with the wider use of color recording in recent years, there are many examples in which the above-mentioned heating means are combined for use particularly as a countermeasure to cope with the increased recording duties.

In the specification of U.S. Pat. No. 5,020,244, a recording liquid fixing apparatus is disclosed in which a hot air heating and a radiant heating are combined. The techniques disclosed for this apparatus are such that energy saving is implemented for heating devices by circulating most of the hot air in the circular path arranged in the positions of heating devices, and also, in the carrier path of a recording sheet. In the specification of U.S. Pat. No. 5,428,384, a heater blower system is disclosed for use with a color ink jet printer. This system is such that by the combination of an air blasting and exhaust means, together with a radiant heating method, it is intended to produce a better recording of a higher quality with the evaporation of ink droplets adhering to a recording material, while effectively removing the vapor thus generated.

In the specification of Japanese Patent Laid-Open Application No. 8-258254, there is disclosed the means in which heating means using a heat roller, and blowing means are provided for heating a recording sheet to make it possible to apply heat to the recording sheet before and after printing by the provision of a large contact angle for the recording sheet with respect to the circumferential surface of the heat roller, at the same time, making it possible to blow air from below and above in the same direction as the carrying direction of the recording sheet, thus removing the vapor to be generated, and at the same time, cooling the recording head.

As an individual means of heating fixation, there is disclosed in the specification of U.S. Pat. No. 5,479,199, a radiant heating method wherein a reflection plate is provided for a wire heater, and a recording medium is heated from the reverse side thereof immediately under printing. In the specification of Japanese Patent Laid-Open Application No. 5-338126, a method is disclosed for heating and drying a sheet by the application of hot air from the reverse side thereof. Also, in the specifications of Japanese Patent Laid-Open Application No. 7-195683 and Japanese Patent Laid-Open Application No. 7-314661, means is disclosed for preventing ink from running and suppressing the deformation of paper sheet (crinkling and curling) resulting from the operation of ink jet recording.

However, in accordance with the conventional examples described above, the adoption of any one of them, such as the hot plate heating plate type, the hot air heating type, the radiant heating type, the heating method in which the hot air and radiant heating are combined, or the microwave heating type, may bring about excessive power dissipation, but the anticipated effect of image quality enhancement is still insufficient, even with the application of heat. It is still difficult for any one of them to cope with the higher speed requirement, the lowered image quality due to the vapor generation, and the larger size of the fixing device itself, among some other problems.

The hot plate heating method in which a recording material should be in contact with a hot plate is of a conduction and heat transfer type. Therefore, rapid heating is difficult, thus making it impossible to meet the higher speed requirement of late. Also, it is impossible to follow the changing condition of contact between the hot plate and the recording material, thus resulting in the drawback that image unevenness is generated.

For the hot air heating method in which hot air is blown onto the recording material, it is necessary to provide a measure to avoid condensation resulting from vapors contained in the hot air. This invites higher costs inevitably. Particularly when this method is adopted for an apparatus that uses the aqueous ink often used for ink jet recording, the generated water vapors bring about condensation in the interior of the recording apparatus, thus corroding electric parts or causing the short circuit thereof. Further, when blowing air to the printed surface, fine ink droplets tend to spread, and cause the degradation of image quality after all. Also, when blowing air to the reverse side of the printed surface, there is a need for the provision of air blocking means for the portions that do not require any heating. As a result, there is a problem that it becomes difficult to make the apparatus smaller.

The conventional radiant heating method uses an infrared lamp or an infrared heater as heating means. However, it is necessary to arrange a reflection plate in order to converge infrared rays to the region where recording is made. As a result, there is a problem that it becomes difficult to make the apparatus smaller. Also, since ink is heated by the infrared rays that should transmit the recording sheet, the heating effect on ink becomes insufficient. The anticipated enhancement of image quality is also insufficient accordingly.

The heating method in which the hot air and radiant heating are combined should require most of the hot air to circulate in the circulating path. As a result, the hot air becomes more moisture-laden as recording progresses. After continuous use, condensation takes place to allow the drops to adhere to the recorded images, thus staining the images or corroding electric parts to cause them to be short circuited or the like.

An ink jet recording apparatus, which is provided with the air blowing and exhausting means combined with the radiant heating method, is capable of instantaneously evaporating ink adhering to the surface of a recording material (paper sheet), thus preventing images from being degraded due to the permeation of aqueous ink into the paper sheet. However, the ink droplets adhering to the recording region are caused to spread by the draft from blowing means. Hence, ink mist flies to spread in the blowing direction and adheres to the circumference of recorded images, leading to the degradation of their quality. Also, if a larger image should be recorded with a larger amount of ink needed for it, the generated water vapors become fog that spreads outside the printer, hence producing unfavorable effects, such as condensation, on the peripheral equipment of the printer.

The recording system disclosed in the specification of U.S. Pat. No. 5,479,199 has a problem that this system cannot be utilized for a smaller printer, because not only the water vapor generation is insoluble, but also, the system cannot be made more compact.

The microwave heating has a considerable effect on aqueous ink. However, there is a problem of the water vapor generation. There are also problems of safety with respect to the human body, as well as of a greater dissipation of electric power. With these in view, this type of heating is not suitable for an ink jet printer for personal use.

Also, the ink jet recording apparatus, which is disclosed in the specification of Japanese Patent Laid-Open Application No. 57-120447, is capable of effectively heating paper pulp, polymeric substance, inorganic filler, ink solvent, or the like by means of a heating and drying device using the far infrared rays whose wavelength is 4 $\mu$m to 400 $\mu$m. Also, in the specification thereof, the far infrared rays whose maximum value of radiant energy intensity is at around 3.5 $\mu$m are disclosed as usable for such apparatus. However, if the far infrared rays of this kind are used, both the recording paper sheet and ink are heated, making it impossible to effectuate any heating fixation that may render a good efficiency. Here, only 50% of moisture can be dried at a sheet feeding speed of 0.5 cm per second.

Further, in the specification of Japanese Patent Laid-Open Application No. 2-182461, it is disclosed that recording sheet and ink are intensively heated and dried by use of far infrared rays having the wavelength of 2 $\mu$m to 1,000 $\mu$m. However, an ink jet recording apparatus of this kind also heats both the recording paper sheet and ink after all. Also, there is no disclosure in the specification as to the spectrum data on the far infrared rays, which should specifically indicate the radiant energy intensity.

SUMMARY OF THE INVENTION

With a view to solving the problems of the conventional art described above, the present invention is designed. It is an object of the invention to provide a smaller ink jet recording apparatus provided with a highly effective heating means capable of obtaining sufficiently enhanced image quality with a lesser dissipation of power, which is rarely subjected to the damage that may be caused by the generation of vapors, as well as to provide a fixing heater to be used for such apparatus.

It is another object of the invention to provide an ink jet recording apparatus having heating means for heating the recording material and recording liquid, which is provided with a heater arranged in a position to face the recording head with radiation characteristics having the peak waveform of the maximum value within a range of radiated infrared radiation ratio $\epsilon$ of 4 $\mu$m to 10 $\mu$m wavelength.

It is still another object of the invention to provide an ink jet recording apparatus having heating means for heating a recording material and recording liquid, which is provided with a heater having radiation characteristics with the peak waveform of the maximum value within a range of radiated infrared radiation ratio $\epsilon$ of 4 $\mu$m to 10 $\mu$m wavelength, as well as with a second heater whose radiation characteristics are different from those of the first heater. Here, the first heater is in a position to face the recording head, and the second heater is in a position to heat the recording material before recording.

It is a further object of the invention to provide an ink jet recording apparatus having heating means for heating a recording material and recording liquid, which is provided with a heater having radiation characteristics with the peak waveform of the maximum value within a range of radiated infrared radiation ratio e of 4 $\mu$m to 10 $\mu$m wavelength, as well as with a second heater whose radiation characteristics are different from those of the first heater. Here, the first heater is in a position to face the recording head, and the second heater is in a position to heat the recording material after recording.

It is still a further object of the invention to provide an ink jet recording apparatus having heating means for heating a recording material and recording liquid, which is provided with a heater having radiation characteristics with the peak waveform of the maximum value within a range of radiated infrared radiation ratio $\epsilon$ of 4 $\mu$m to 10 $\mu$m wavelength, as well as with a second heater whose radiation characteristics are different from those of the first heater. Here, the first heater is in a position to face the recording head, and the second heater is in a position to heat the recording material after recording, and the second heater is each in positions to heat the recording material before and after recording.

FIG .4 is a view which illustrates the effects obtainable by the various combinations of heating means.

Figure 5:
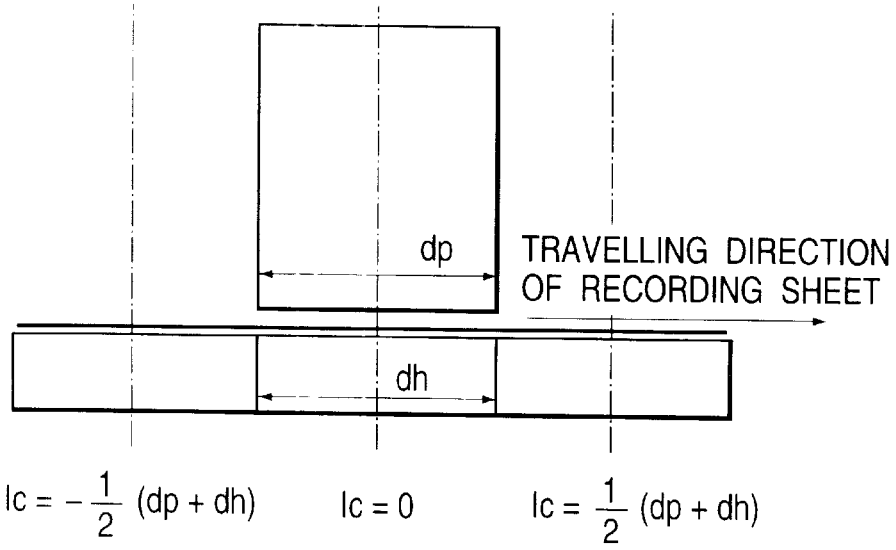

FIG. 5 is a view which illustrates the arrangement location of an energization heater embodying the present invention.

Figure 6:
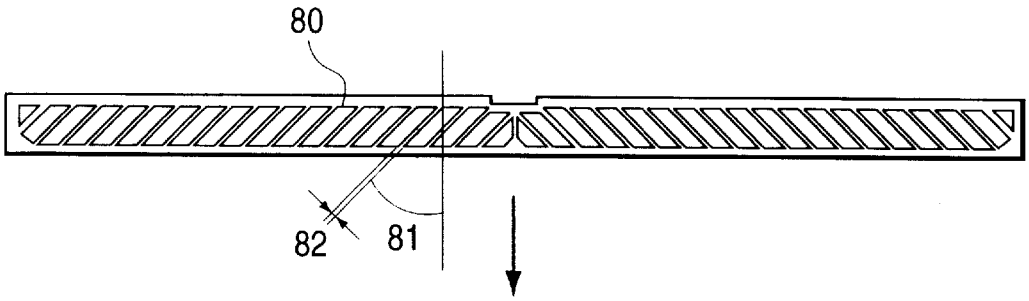

FIG. 6 is a view which shows the structure of a screen grid that contacts and supports a recording material in accordance with an embodiment of the present invention.

Figure 7:
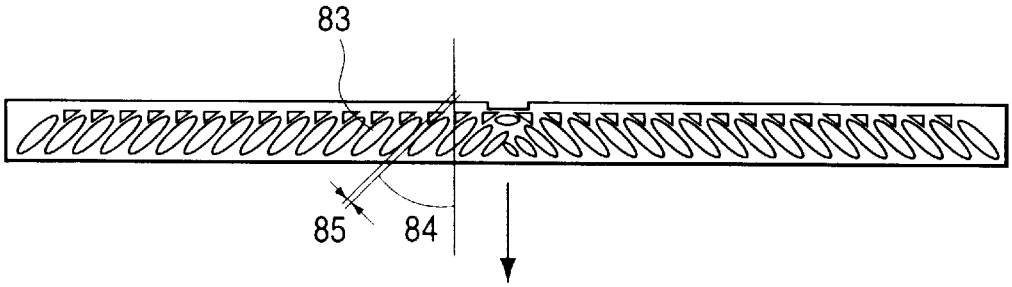

FIG. 7 is a view which shows the structure of a screen grid that contacts and supports a recording material in accordance with another embodiment of the present invention.

Figure 8:
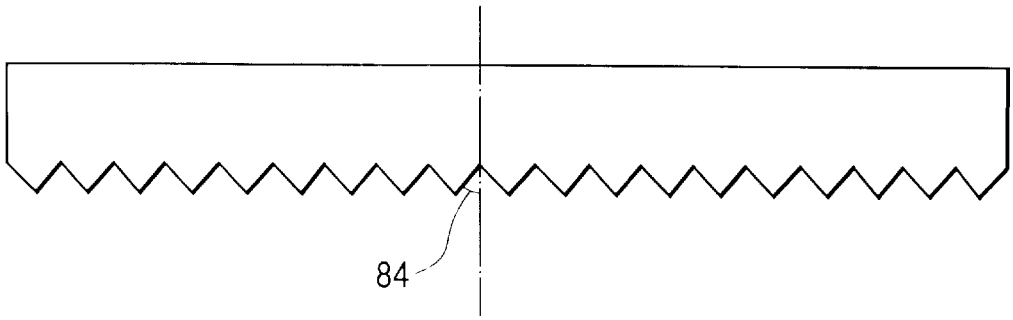

FIG. 8 is a view which shows the structure of the driving circuit of an energization heater embodying the present invention.

Figure 9:
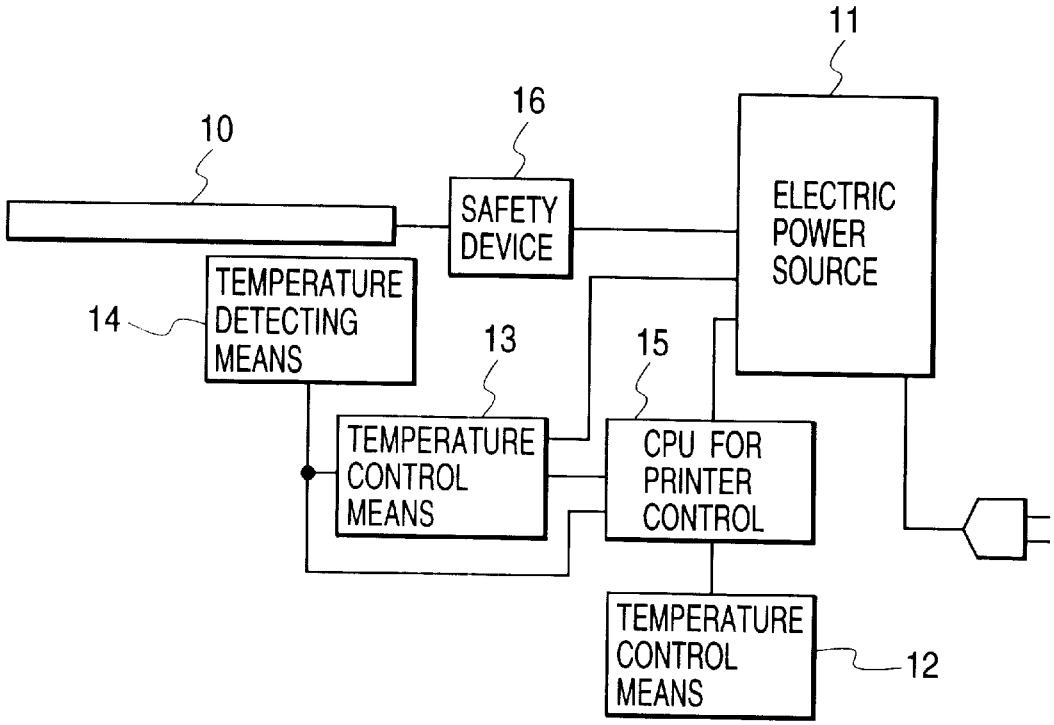

FIG. 9 is a view which shows the structure of the driving circuit of an energization heater embodying the present invention.

Figure 10:
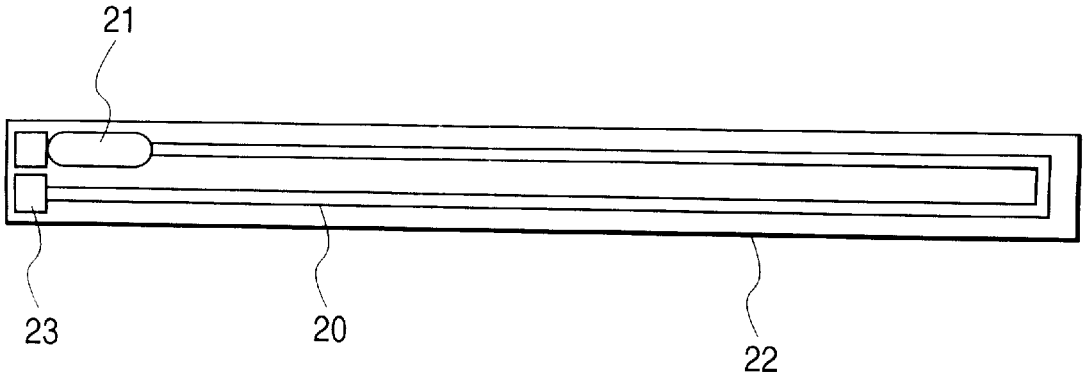

FIG. 10 is a view which shows the structure of the safety device provided for the energization heater itself in accordance with an embodiment of the present invention.

Figure 11:
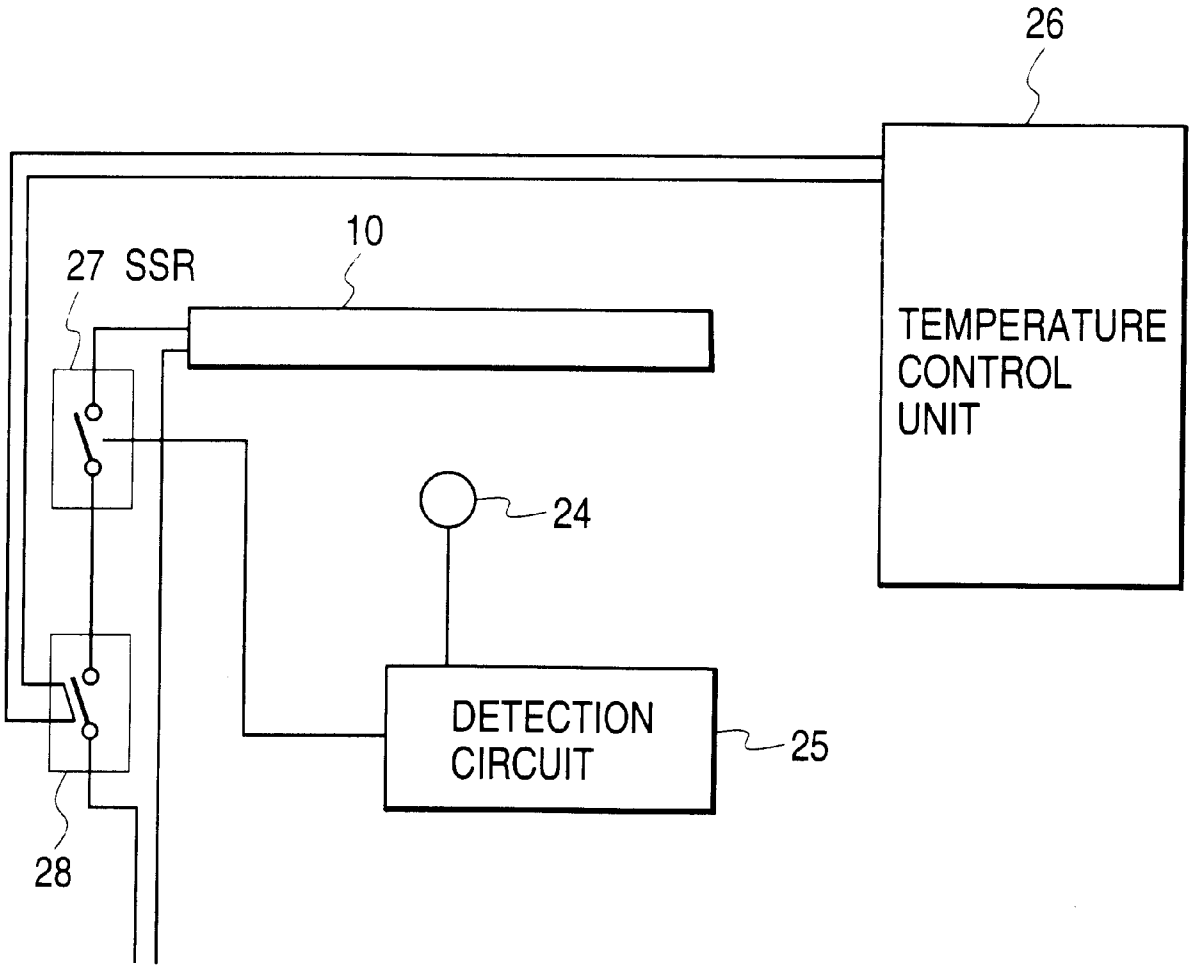

FIG. 11 is a view which shows the structure of the safety device connected outside the energization heater embodying the present invention.

Figure 12:
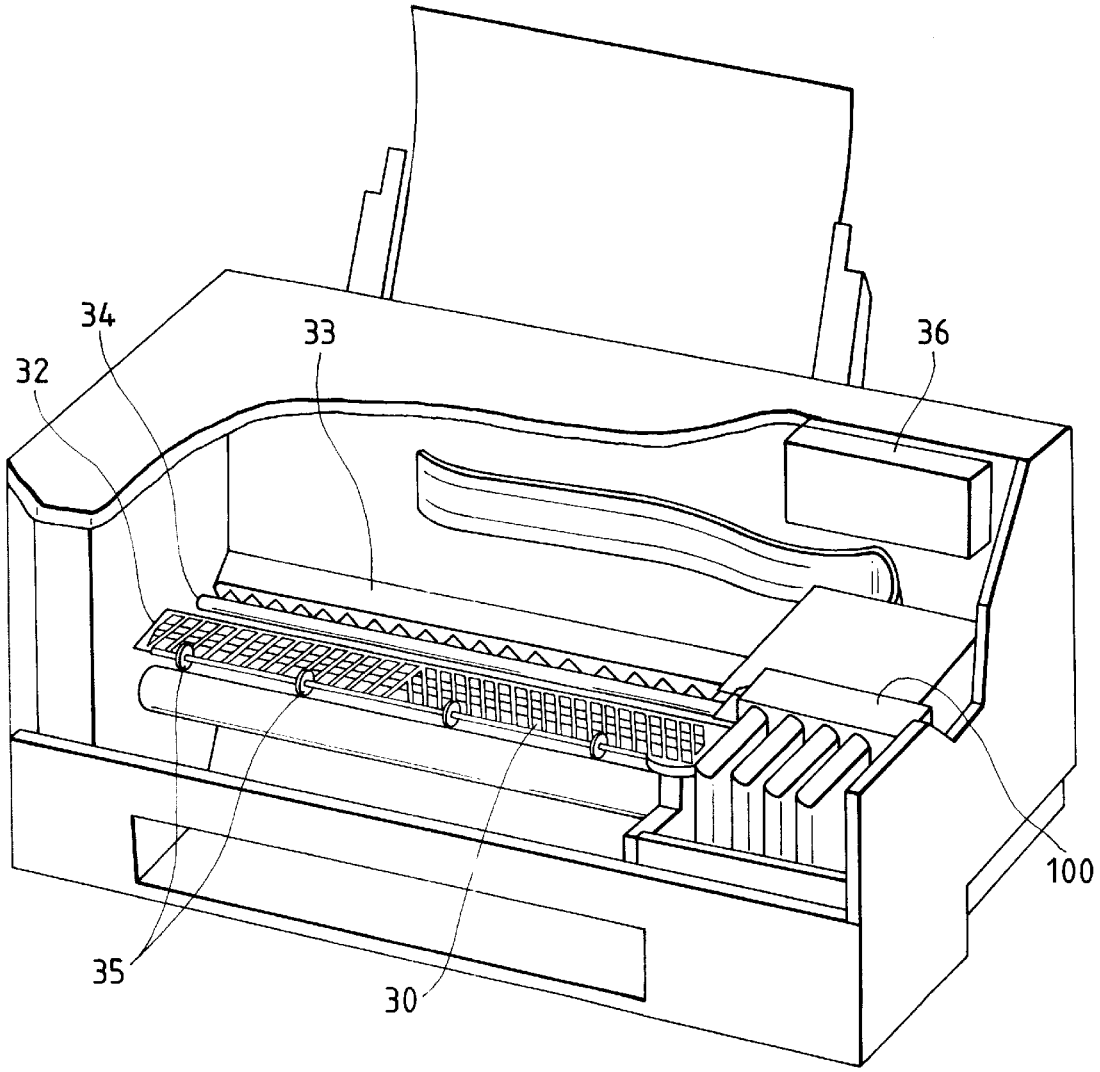

FIG. 12 is a view which shows the structure of an ink jet recording apparatus in accordance with a first embodiment.

Figure 13:
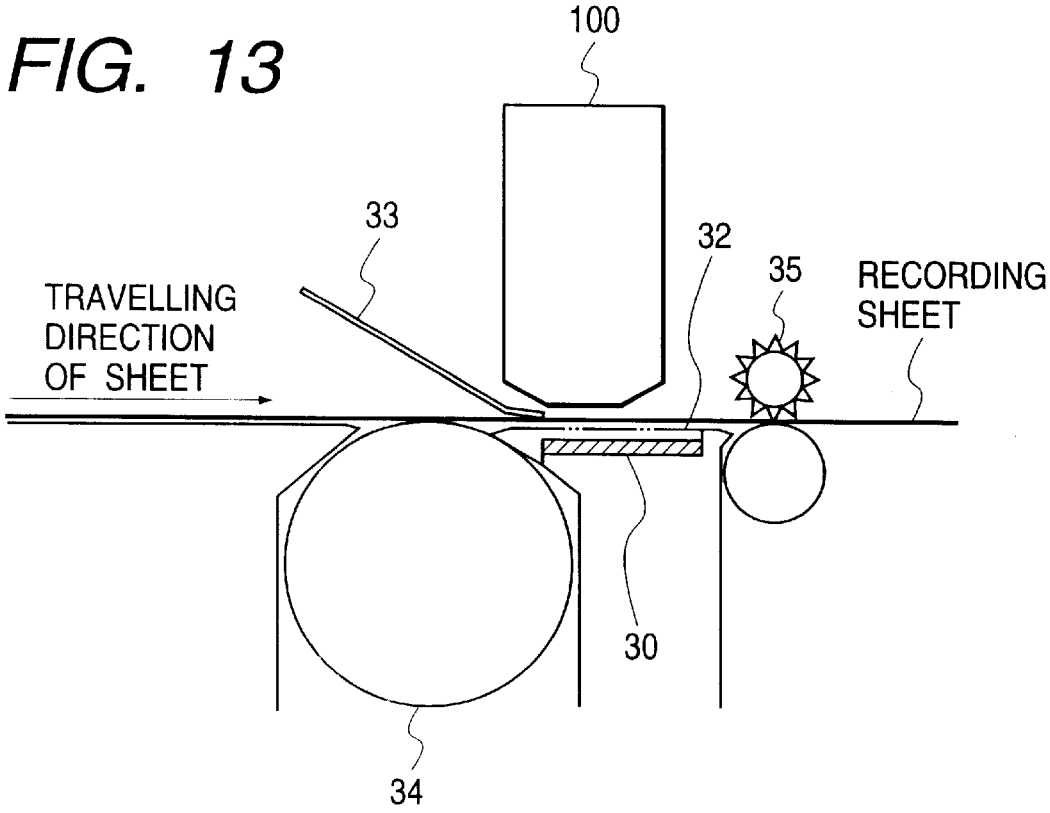

FIG. 13 is a cross-sectional view which shows the relative positions of the respective principal parts of the ink jet recording apparatus in accordance with the first embodiment.

Figure 14:
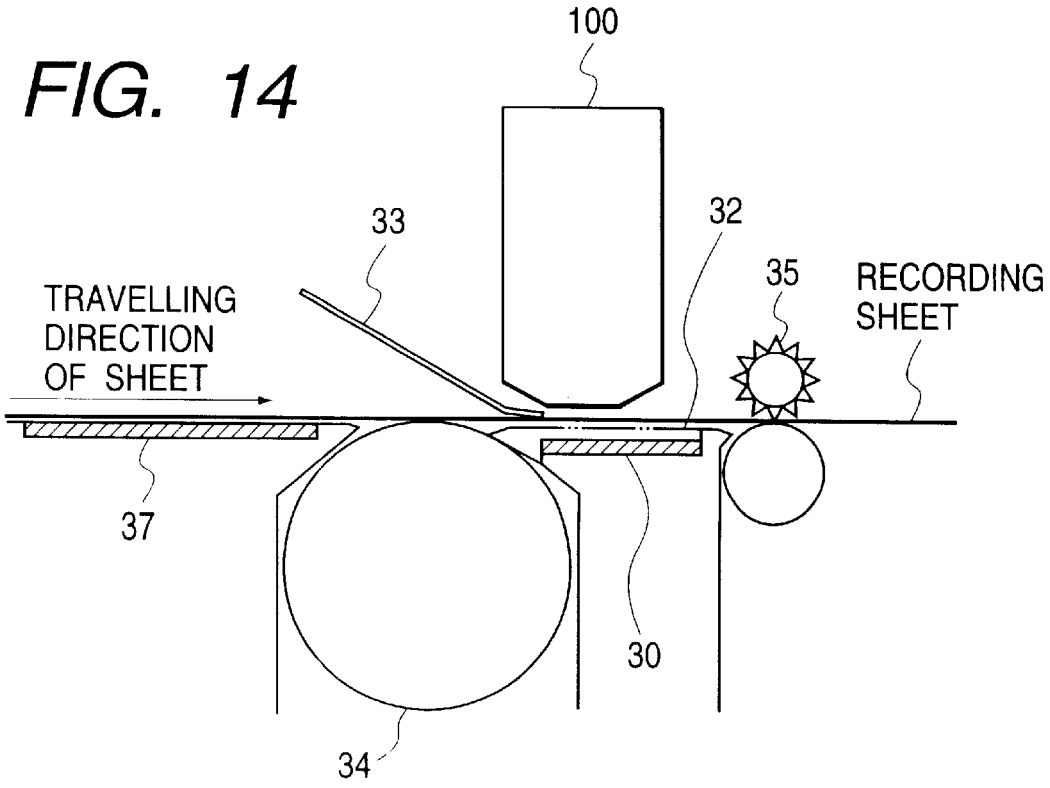

FIG. 14 is a view which shows the structure of an ink jet recording apparatus in accordance with a second embodiment.

Figure 15:
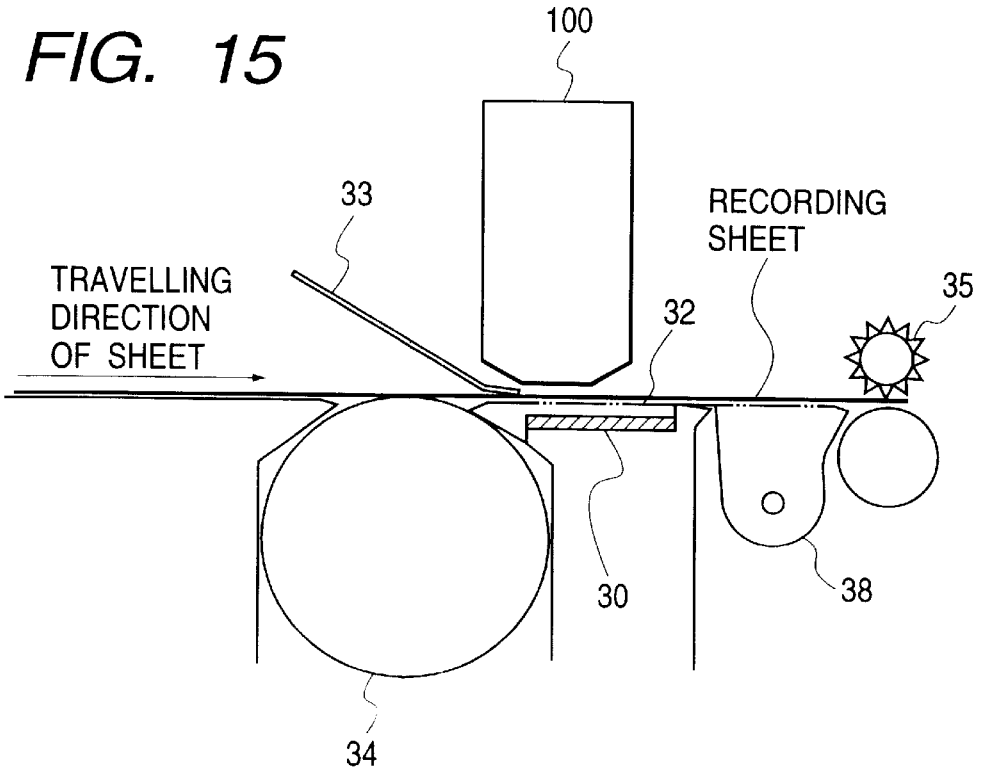

FIG. 15 is a view which shows the structure of an ink jet recording apparatus in accordance with a third embodiment.

Figure 16:
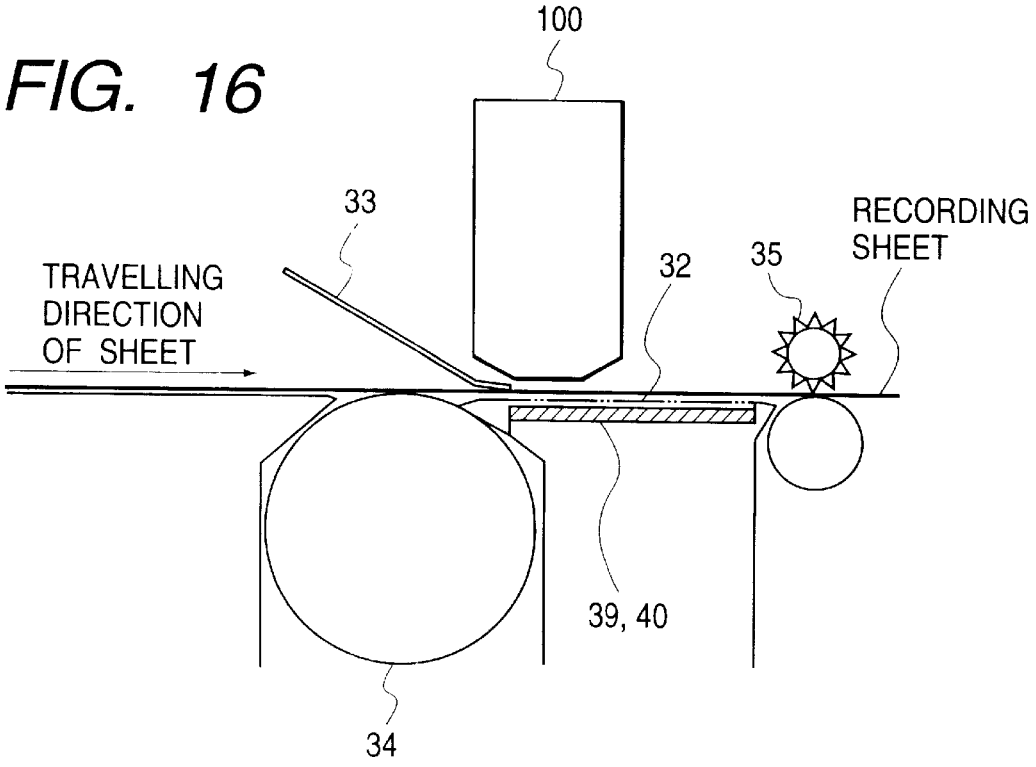

FIG. 16 is a view which shows the structure of an ink jet recording apparatus in accordance with a fourth embodiment.

Figure 17:
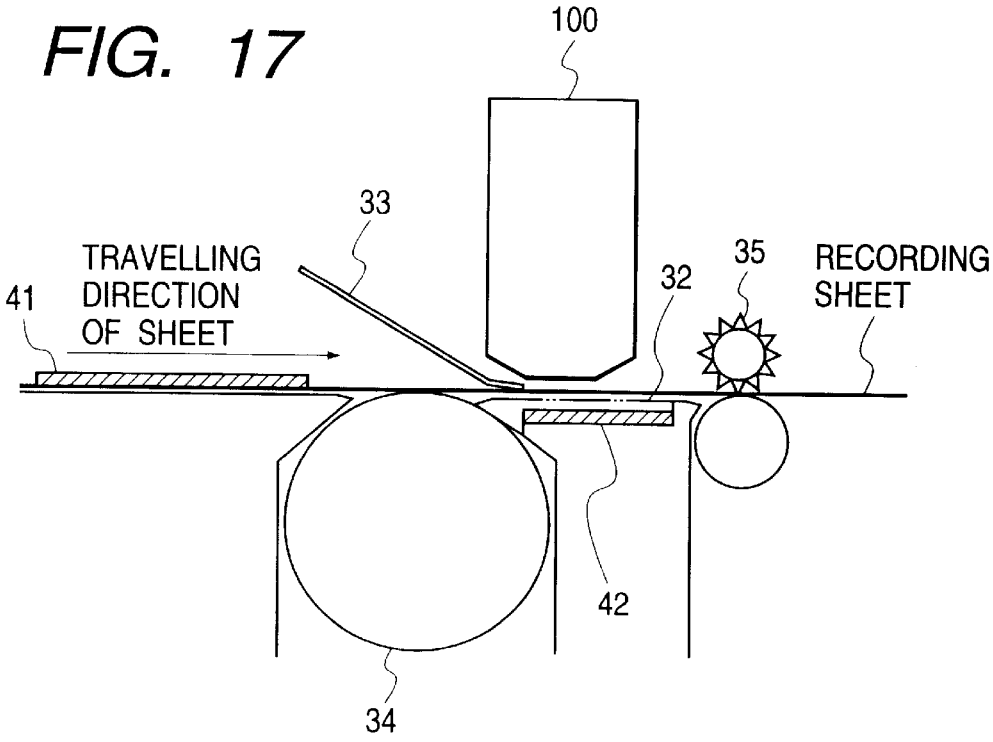

FIG. 17 is a view which shows the structure of an ink jet recording apparatus in accordance with a fifth embodiment.

Figure 18:
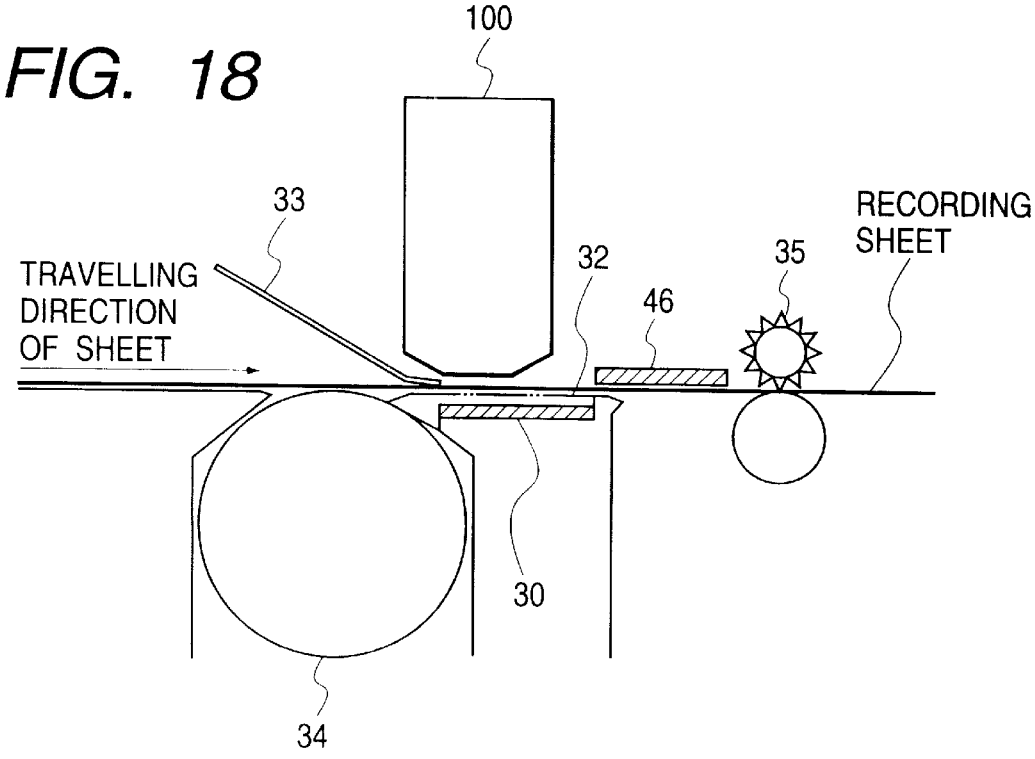

FIG. 18 is a view which shows the structure of an ink jet recording apparatus in accordance with a sixth embodiment.

Figure 19:
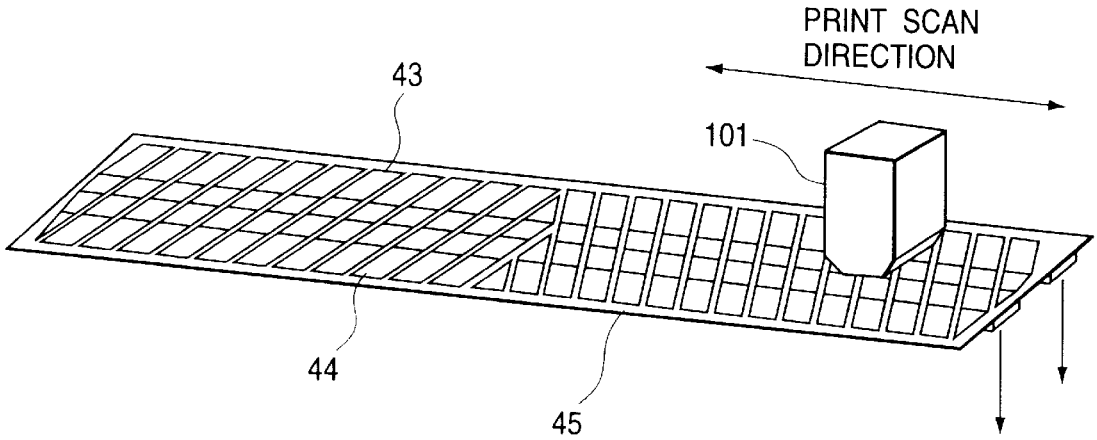

FIG. 19 is a view which shows the structure of an ink jet recording apparatus in accordance with a seventh embodiment.

DETAILED DESCRIPTION OF THE PREFERRED EMBODIMENTS

With reference to the accompanying drawings, the description will be made of the embodiments in accordance with the present invention.

In this respect, while giving particular attention to the radiation and absorption characteristics of infrared rays, which have not been taken into consideration by the conventional art, the inventors hereof have analyzed such characteristics and attained the development of an ink jet recording apparatus which is provided with ideal heating means.

(Embodiment 1)

Figure 1:
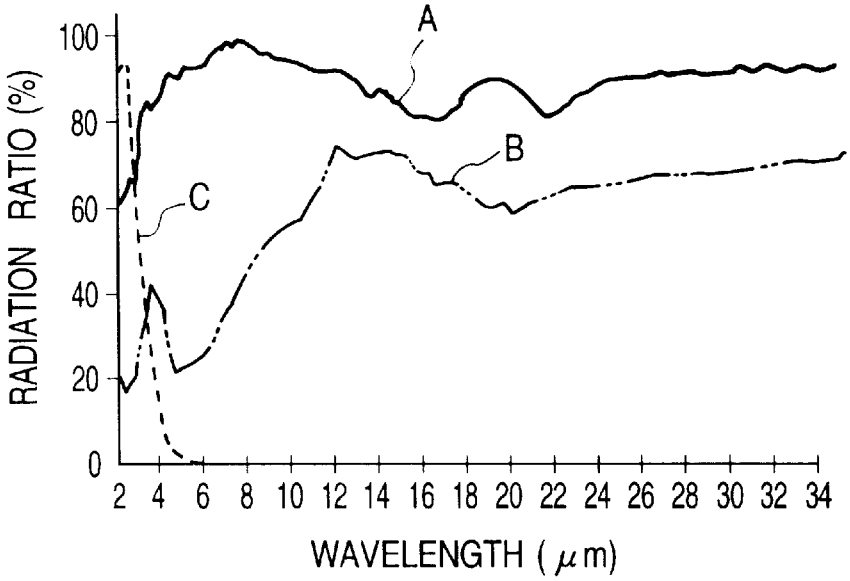
FIG. 1 is a graph which shows the measurement data on the infrared radiation ratio of energization heaters. The curved line A represents them for the energization heater in accordance with the embodiment of the present invention. The curved line B represents them for the conventional ceramic heater. The curved line C represents them for the infrared radiation ratio of the infrared lamp.

FIG. 1 is a view which shows the results of measurements of the infrared radiation ratios of the energization heater embodying the present invention and the energization heater conventionally in use, which represents a reference example. The measurements are made by use of the Fourier Transform Infrared Spectrometer (hereinafter referred to as an FT-IR device).

In FIG. 1, the energization heater (heating means) whose characteristics are indicated by the curved line A is used for the present invention. This heater is formed by the provision of a complex oxide film containing Si, Fe, Zr, Ti, and Mn on the surface of the so-called ceramic heater. The energization heater whose characteristics are indicated by the curved line B is formed by a ceramic heater having Zr oxide film on the surface thereof, and is conventionally used as a far infrared radiation device. The one whose characteristics are indicated by the curved line C is an infrared lamp.

Each of the curved lines is shown in the form of radiant spectrum per wavelength on condition that the size of each heater is made to be mountable on the FT-IR device. For the ceramic heaters indicated by the curved lines A and B, the DC1 is applied at 9V and 4 A so as to set the surface temperatures thereof at 156° C., and that with the region whose infrared wavelength is 2 $\mu$m to 35 $\mu$m being set at the same temperature of a sample, the ratio between the intensity of infrared radiation of the sample and that of the ideal black object is defined as the radiation ratio $\epsilon$.

For the infrared lamp indicated by the curved line C, the specific power is supplied, and the measurement is made in the same manner as described above.

As shown in FIG. 1, the radiation ratio of the conventional heater, which is indicated by the curved line B, is lower in the shorter wavelength side, and its peak arrives at around 12 $\mu$m. The heater used for the present invention, which is represented by the curved line A, shows the $\epsilon$=0.8 or more in the region of the measured wavelength 3 to 35 $\mu$m, and the peak of the radiation ratio thereof arrives at around 7 $\mu$m. The radiation characteristics of the infrared lamp, which is indicated by the curved line C, are different from those of the ceramic heaters greatly. At 2 $\mu$m, the peak of the radiation ratio is present, and then, the distribution thereof is parabolic. There is almost no radiation ratio at the wavelength of 5 $\mu$m or more.

Figure 2B:
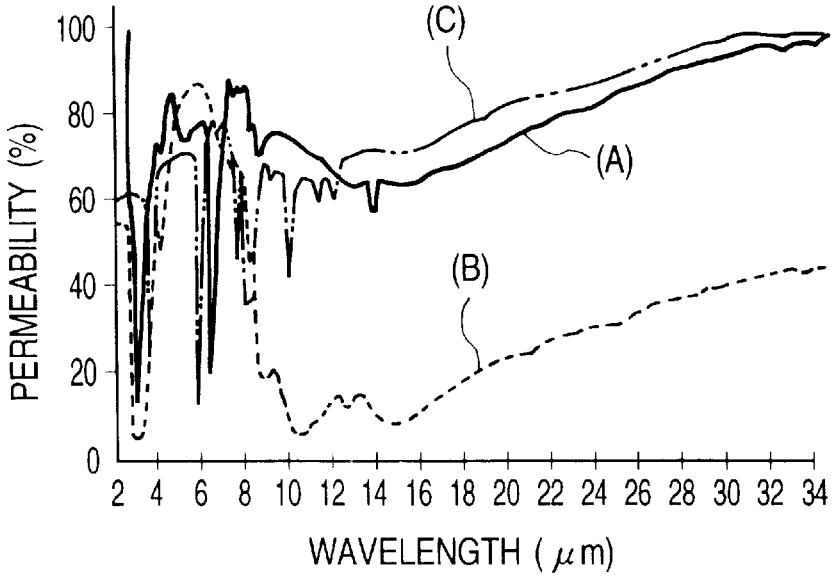
FIG. 2B is a graph which indicates the three spectra represented in FIG. 2A, together.
Figure 2A:
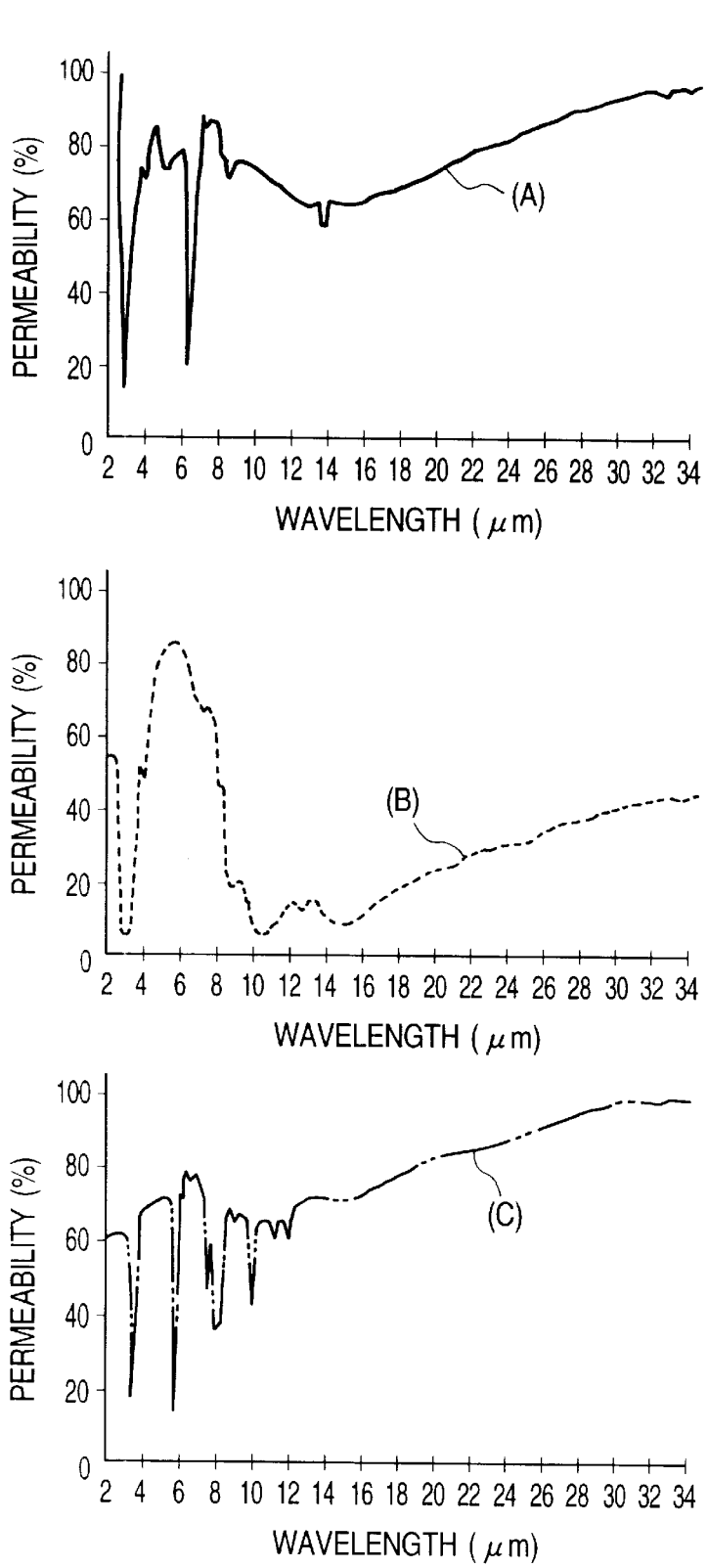
FIG. 2A are graphs which represent the measurement data on the infrared absorption spectra of heated objects. The curved line A indicates aqueous ink; B, a recording sheet; and C, non-aqueous ink, respectively.

FIGS. 2A and 2B are the graphs which illustrate the results of measured infrared absorption characteristics (the so-called infrared absorption spectra) of the heated objects by use of the FT-IR device. Here, FIG. 2B shows the three spectra represented in FIG. 2A together.

In FIGS. 2A and 2B, the curved line A indicates the IR spectrum of ink composed of water soluble dyes C.I. food black 23%, and $H_2O$ for the remaining portion; B, the IR spectrum of the recording paper sheet prepared in the form of KBr tablet after the ordinary paper sheet for office use is powered; and C, the IR spectrum of ink composed of oil dyes C.I. solvent black 33%, and ethyl acetate for the remaining portion.

In accordance with A, the infrared absorption of ink presents its main absorption at around 2.8 $\mu$m and 6.3 $\mu$m. The former is brought about by the H—H stretching vibration, and the latter, by the H—O—H deformation vibration. In accordance with B, the infrared absorption spectrum of the recording paper sheet presents the intensive absorption within a range of approximately 3 $\mu$m to 11 $\mu$m.

Now, comparing A and B, it is clear that the infrared rays are absorbed by both ink and paper sheet at around 3 $\mu$m, but at around 6 $\mu$m, the infrared rays are more absorbed by ink, and less by paper sheet. Also, it is clear that at around 10 to 11 $\mu$m, the infrared rays are more absorbed by paper sheet than ink.

In accordance with C, intensive absorption by non-aqueous ink is present at 5.8 $\mu$m and at 7.5 to 8.3 $\mu$m. As compared with the recording paper sheet B, the infrared absorption by ink is greater at around 5.8 $\mu$m, while the infrared rays are absorbed both by paper sheet and ink at around 7.5 to 8.3 $\mu$m.

Either for aqueous and non-aqueous ink, the factor that determines the infrared absorption spectra is mainly controlled by solvent. As shown at A and B, the infrared absorption spectra are generally applicable both to aqueous ink and non-aqueous ink. Also, as to recording paper sheet, if it is for use in ink jet recording, its infrared absorption approximates the infrared absorption spectrum at B.

The wavelength range of less than 4 $\mu$m is the one where the absorption of ink and that of paper sheet are overlaid. The infrared rays within this range are capable of heating both ink and paper sheet. As a result, at less than this wavelength, heat given to ink is generated by the infrared energy that has passed the paper sheet after heating the paper sheet. Thus, the energy generated in the heating source is not used efficiently for heating ink. Likewise, within a range of more than 10 $\mu$m, the absorption by paper sheet is more intensive. Therefore, ink adhering to paper sheet does not absorb infrared rays more (the infrared rays tend to transmit ink). As a result, at the wavelength of 10 $\mu$m or more, energy used for giving heat to ink is mostly absorbed by paper sheet. Thus, the ink heating efficiency becomes extremely unfavorable. It is preferable to arrange the wavelength range of a heating source so as to provide its peak waveform at the maximum point of the energy distribution at 4 to 10 $\mu$m.

With the absorption characteristics of the heated objects being related to the radiation characteristics of the heating source, the combination of each of the heated objects at A and B, and at C and B presents the following:

(X) If the heating source whose characteristics are indicated by the curved line A in FIG. 1 is used, the heating effect is high on ink.

(Y) If the conventional heating source whose characteristics are indicated by the curved line B in FIG. 1 is used, the heating effect is high on paper sheet.

(Z) If the infrared lamp whose characteristics are indicated by the curved line C in FIG. 1 is used, the heating effect is unfavorable both on ink and paper sheet.

In order to enhance the quality of recorded images by changing the state of a heated object by the application of heat, it is known that ideal heating means is the one that can provide a better thermal action on recording liquid or ink with which to form images (such as to suppress spreading, to prevent color mixture, to enable colorants to produce better colors). Also, there is an upper limit of heating temperature with respect to a recording material. As a result, if ink should be heated indirectly from the recording material, there is also a limit as to the heating effect accordingly. With this in view, the inventors hereof have arrived at the conclusion that ideal heating means can be materialized only in the case of the X described above where the characteristics of infrared radiation of a heating source can be arranged to agree with those of the infrared absorption by ink.

The energization heater is structured in the same manner as a thermal head. For example, it is preferable to use the one formed by a substrate, such as alumina or glass, provided with a pattern formed as a resistor by a conductor, such as gold (Au), silver (Ag), platinum (Pt), palladium (Pd) or a compound thereof. Also, in order to improve the characteristics of its rising temperature, it may be possible to arrange a resin layer, such as polyimide, having a lower rate of thermal transfer between the resistor and the substrate. It is preferable to design the resistor pattern so that the temperature distribution of the heater becomes smaller in the longitudinal and width directions. Also, it is desirable to arrange a protection layer for the surface of the resistor by use of glass or some other ceramic coating so that the inner resistor is prevented from abrasion, erosion, shocks, or the like. The thickness of the protection layer and the material thereof are selected depending on the design specification, such as temperature and, heat response, among some other factors.

The energization heater of the present embodiment is an infrared radiation device which is capable of radiating the spectrum having its peak wavelength of the maximum radiation ratio within a range of the wavelength 4 to 10 $\mu$m. To obtain such heater, the infrared radiation film is provided for the surface layer of the energization heater. This layer arrangement may be a film that contains oxide of two or more kinds of elements selected from among the element group given below or may be an oxide film that contains carbon and one or more kinds of elements selected from among the element group given below. It is more preferable that the protection layer itself is a film that contains the above-mentioned oxide.

Mg, Al, Si, Ti, Cr, Mn, Fe, Co, Ni, Cu, Zr.

As the composition of the film, it is preferable to make the element, such as Si, Fe or Zr, the main component. Here, the main component element is contained at least at 40 wt % or more, and then, other elements are selected in order to enhance the infrared radiation ratio and to adjust the wavelength that indicates the maximum radiation ratio.

As an example of a preferable film composition, there can be named: oxide film composed of Si 55, Fe 18, Zr 15, Ti 8, and Mn 4 (wt %); multi-element oxide film composed of Fe 45, Cr 12, Si 10, Mn 10, Cu 8, Ti 8, Zr 5, and Mg 2 (wt %); and oxide film containing carbon, which is composed of Si 70, Cl 5, and Al 15 (wt %), among others.

Here, in accordance with the present invention, the element group is designated, but there is no influence exerted on the effect thereof even if the film may contain impurity elements included in a film formation material.

The film is formed by burning after coating a mixed paste, which is prepared by mixing each of metallic fine resin pastes, on the substrate in a specific ratio by means of screen process printing, spraying, spin coating, or the like.

Figure 3A:
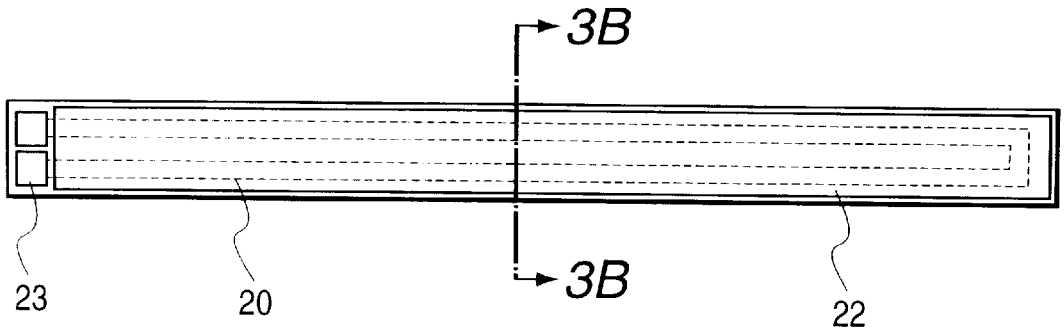
FIG. 3A is a plan view which shows the structure of an energization heater embodying the present invention.
Figure 3B:
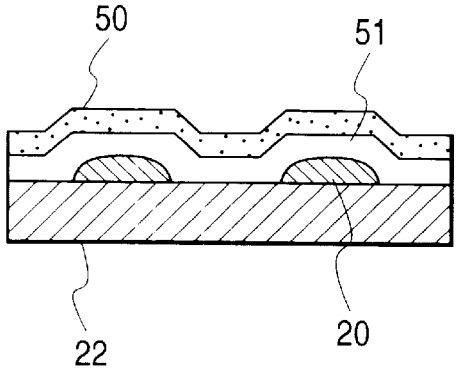
FIG. 3B is a cross-sectional view of the heater represented in FIG. 3A.

Also, it may be possible to form the above-mentioned film on a protection layer made of glass or the like. If the thickness of the film is up to approximately 100 $\mu$m, its heat efficiency is not affected unfavorably. Therefore, it is advisable to adopt the inexpensive ceramic heater conventionally in use. In other words, the material used for the present invention may be coated on the surface of the conventional heater. FIGS. 3A and 3B show such an example, the description of which will be made hereunder.

FIG. 3A is a plan view which shows an energization heater structured as described above. FIG. 3B is a cross-sectional view taken along line 3B—3B in FIG. 3A. In FIGS. 3A and 3B, a reference numeral 20 designates a heat generating resistor pattern formed by an alloy of Ag—Pd; 22, an alumina substrate whose thickness is 0.6 mm; 23, electrodes; 50, an infrared radiation film used for the present embodiment; and 51, a protection layer made of fusion glass. In this manner, the infrared radiation film used for the present embodiment is formed on the surface of the conventional heater, hence making it possible to produce the energization heater that demonstrates the effect of the present embodiment at lower costs.

Now, the detailed description will be made of the position in which a recording material is heated. In this respect, a recording paper sheet is used as the representative recording material.

Figure 4:
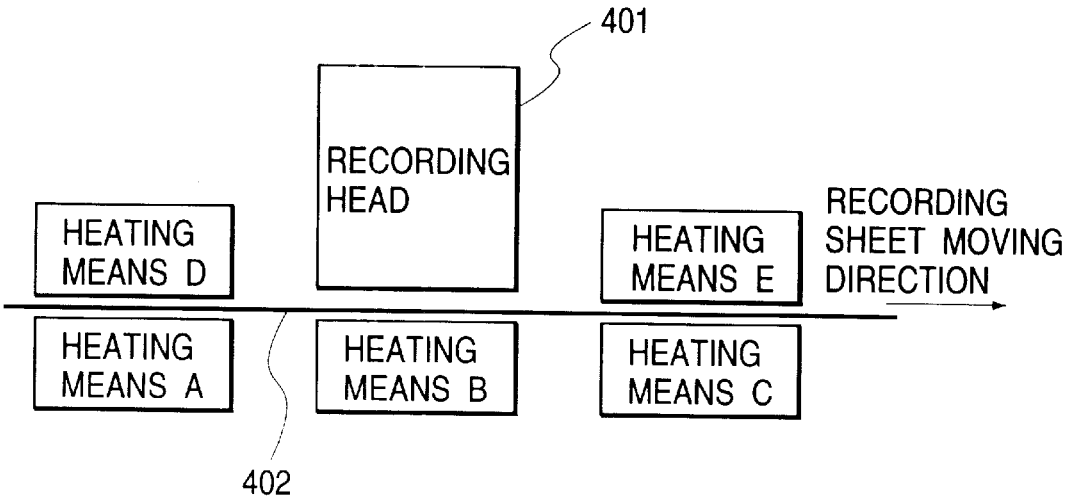

The positions in which a recording paper sheet is heated can be divided roughly into three; (1) before recording; (2) in the recording head unit; and (3) after recording. Further, it may be possible to set the heating positions at the surface and reverse sides of the recording paper sheet in each of the positions (1), (2), and (3), respectively. There are 63 positions in total that enable the heating positions to be combined. However, in order to heat the surface of the recording paper sheet in the position (2), that is, in the recording head unit, the required technique is different from those used for the present invention. Therefore, such technique is not included in the subject of the present invention. FIG. 4 is a view which illustrates the anticipated effects obtainable when various heating means are combined in many ways on the basis of the thought described above. In FIG. 4, each of the heating positions is designated by the letters of the alphabet in order to make the positional arrangement easily understandable. Heating means B is positioned to face a recording head. Any other positions of heating means than that of B are those where no projection of the recording head 401 is possible. It is assumed that these heating means are positioned in the horizontal direction at equal intervals to each other. Also, all the heating means are the same and are arranged to be in contact with the recording sheet 402 (sheet for copying use).

At first, heating means A to E are divided into one location, two locations, three locations, four locations, and five locations, respectively, and heating is given at the same temperature in any one of the locations. Then, while the recording sheet is being carried at 10 mm/sec in the direction indicated by an arrow in FIG. 4, characters are recorded on it by means of an ink jet recording head. Recorded characters are observed in enlargement to examine the quality of recorded characters and classify them into five ranks, such as 1, 2, 3, 4, and 5 (5 for the best), in order of those showing better quality. As a result, those means which provide the quality ranks of 4 and 5 are the following three:

(K) heating means B (L) heating means A and heating means B heated at two locations simultaneously (M) heating means B and heating means D heated at two locations simultaneously By the heating means C and E, no contribution is made to the enhancement of the quality of recorded characters if already heated in the three locations described above. However, it is found that these means produce effects on correcting the thermal deformation of the recording sheet after printing, as well as on drying it sufficiently in a better condition.

Then, the surface temperature of heating means B is set at 60° C. to 300° C. by every 10° C. Recording is then performed in each condition in order to obtain the temperature T5 at which recorded characters present the rank 5. Under this condition, the T5 is 180° C. Further, with the heating performances of (L) and (M) in the heating positions A, B, and D, the surface temperature of each heating means is arranged to change within a specific temperature range centering on T5, thus ranking the quality of recorded characters. In this way, the relationship between the surface temperature of each heating means and the quality of recorded characters is ascertained for each combination of heating positions in (K), (L), and (M), respectively.

Here, if the temperature in the heating position D is made 100° C. or more, moisture in the recording paper sheet is evaporated to bring about condensation on the reverse side of the sheet. Then, water droplets tend to adhere to it. In some cases, the adhering water droplets may drop off from the reverse side of the sheet onto the surface of the apparatus, hence damaging the interior of the printer. Therefore, the upper limit should be set for the heating temperature in the heating position D so that no water droplets are generated.

In the heating position B, heating is given from the reverse side of paper sheet. As a result, moisture in the recording paper sheet and ink is evaporated to the surface side of the paper sheet, and then, with the provision of an appropriate exhausting means, generated vapors are exhausted. In this manner, unlike in the heating position D, the possibility of condensation in the interior of the printer is much smaller. Here, part of generated vapors may adhere to the surface of the recording head. However, this vapor adhesion can be removed by means of the head wiping mechanism. Further, vapors adhering to the interior of nozzles of the recording head may supply water to ink in the fine nozzles. Thus, this adhesion contributes to preventing the ink component from being solidified in the nozzles due to heating. With such advantage also in view, this heating position is the best of all to be selected for maintaining the recording reliability.

Under the circumstances, it is understandable that the following arrangement should be made in order to obtain the best quality of recorded characters.

For the heating position (K), the surface temperature of the heating means B should be at the T5 or more.

For the heating position (L), the surface temperature of the heating means B should be at T5 or more and the surface temperature of the heating means A should be at less than the T5.

For the heating position (M), the surface temperature of the heating means B should be at the T5 or more and the surface temperature of the heating means D should be at less than the T5.

Further, it is found that the temperature of the heating means A or the heating means D may be set at far less than the T5 within a range that satisfies the relationship described above if the obtainable heating area can be made large enough, because this arrangement contributes to controlling the amount of moisture contained in a recording sheet constantly, as well as to keeping recording paper sheets in a specific size constantly.

In other words, if the heating means B is used individually, the temperature should be at the T5 or more. If the heating means A and B are combined or heating means B and D are combined, it should be controlled so that the relationship between the respective surface temperatures maintains B≧A or D.

The temperature T5 varies depending on the kinds of recording materials, the kinds of ink, and the ratio of shooting amounts of ink. In any case, however, it should be controlled so as not to allow the temperature to cause any thermal decomposition of the recording material irrespective of the heating positions.

When heating is given to the reverse side of a recording sheet by use of heating means B in the position that faces the recording head, the above-mentioned ceramic heater is used as the energization heater. However, for the heating means A or heating means C, D, E, it should be good enough if only a specific temperature is obtainable. Therefore, there is no restriction on the heating methods. This is because, in the positions other than B, if only the recording sheet is effectively dried, it should be sufficient. Thus, the conventional art that adopts the hot plate heating, hot air heating, radiant heating, or the combination of these heating methods is still applicable. Also, each arrangement of the heating means A, B, C, D, E is determined in consideration of the measures required to deal with the radiant heat given to the recording head, or in accordance with the width of a recording head, the recording speeds; the recording densities, the amount of ink discharge, the amount of solvent in ink, the permeating speed of ink into the paper sheet, and the viscosity of ink, among some other factors. Particularly for the heating means B, its position is supposed to face the recording head, but it may be possible to offset the position of the energization heater either to the heating means C side or the heating means A side from the center of the recording head so as not to allow the radiant heat from the heater to be irradiated directly onto the recording head. In this case, the heating width of the energization heater should be more than ½ of the recording width of the recording head (if divisional recording is performed by use of multiple path, the recording width should be for one divisional portion), and it is preferable to position the heater so that more than ½ of the recording width should be overlapped with the heating width of the energization heater when these widths are projected. The reasons for this preference will be described below.

As shown in FIG. 5, the following three conditions are studied with the heating temperature of heating means being set at the T5 as described earlier, while defining the recording width as dp, the heating width as dh, the distance between the centers of the recording width and heating width as Ic, the center of the recording width at the datum point=0 of the central position of the heating width, the heating position in the traveling direction of the recording sheet as +, and the front side of the central position of the recording width as −. In this respect, FIG. 5 represents the case where the relative relationship between the recording width and heating width is dp=dh.

Now, when dp<dh, the heating effect is recognizable if the condition is made to be −½ dh<Ic<½ dh. When dp=dh, the heating effect is recognizable at the condition of −½ dh<Ic ½ dh. When dp>dh>½ dp, the heating effect is recognizable at the condition of −dh≦Ic≦dh. When 0<dh<½ dp, no heating effect is recognizable at any one of the heating positions.

The heating means A and D, and the heating means C and E are auxiliary means to enhance the image quality by the application of heat. Therefore, it is unnecessary for them to face each other. Also, if the energization heaters are incorporated integrally on the substrate as the heating means A and B, and the heating means B and C, the heating distance to the recording sheet becomes longer. As a result, it is made possible to secure the flatness of the recording sheet, hence obtaining a higher effect on the improvement of ink coloring. The costs of manufacture are also made lower accordingly.

Now, studies have been made of the energization heater in a mode where it is in contact with a recording material. However, with a structure thus arranged, there is a possibility that the surface of the energization heater is worn away in long run by the recording paper sheet or the like, and that as the use time elapses, the heating effect becomes lower. Also, with the structure described above, it is difficult to keep the recording paper sheet and the energization heater to be completely in contact with each other all the time during the recording operation, because of the irregularities of the surface of the recording material and the energization heater as well.

For the present embodiment, with the non-contact recording structure in view, optimization is attempted by the following techniques in consideration of the infrared radiation characteristics of the energization heater.

An energization heater is installed within a distance where the radiant intensity of infrared rays from the heater is not attenuated, while supporting a recording paper sheet or other recording material in contact therewith. As a device that can support the recording material in contact therewith, it is preferable to arrange the one which is in the mode of netting, for example, and at the same time, it can be heated uniformly over the entire recording region. Also, such supporting device should be conditioned so that it does not catch the tip or the leading end of the recording material while it is in progress, and that the device itself is not heated to raise its temperature for safety purposes (skin burning prevention). For example, if a recording paper sheet should be carried for a specific amount for recording, it may be possible to arrange the supporting device in the form of a screen grid provided with a number of apertures having an opening angle in the moving direction of the recording paper sheet. The opening angle of the aperture portion is set at 45° as standard to the line of the moving direction of the recording paper sheet, and then, the length of the longer side of the aperture portion should be designed to be approximately 2½ times the recording width of the recording head (the numbers of discharge openings n/recording density dpi).

FIG. 6 is a plan view which shows a preferred screen grid embodying the present invention. The screen grid shown in FIG. 6 is formed by SUS 304 having a plate thickness of 0.1 mm, which is ground until the surface roughness becomes 1.0 μm or less. In FIG. 6, an arrow (→) indicates the traveling direction of the recording paper sheet. The aperture portion 80 is formed by means of etching to be symmetrical to the left and right from the center of the screen grid. The opening angle 81 of the aperture portion 80 is 43°. The width 82 of the grid is 0.4 mm. Here, however, the configuration of the aperture portion 80 is not necessary quadrangular. It may be egg-shaped.

FIG. 7 is a detailed view which shows a screen grid having the egg-shaped aperture portion. This grid is formed by SUS 304 whose plate thickness is 0.1 mm. It is ground until the surface roughness becomes 1.0 μm or less. In FIG. 7, an arrow (→) indicates the traveling direction of the recording paper sheet. The aperture portion 83 is formed by means of etching to be symmetrical to the left and right from the center of the screen grid. The opening angle 84 of the aperture portion 83 is 45°. The width 85 of the grid is 0.4 mm.

The surface of the screen grid and the edge of the aperture portion thereof shown in FIG. 6 and FIG. 7 should be processed by means of grinding, etching, or the like to smooth its contour so that the contact friction with the recording paper sheet is made as small as possible. It is preferable to form the screen grid by stainless steel, coated steel plate, or the like. Then, in order to avoid the temperature rise of the screen grid itself, its surface is mirror-finished to make its infrared radiation ratio 0.1 or less. In other words, the arrangement is made so that most of the infrared rays should be reflected. If the screen grid is formed by such material and in such configuration, it is possible to fulfill the safety requirement described earlier.

Here, the experiments are conducted to examine the characteristics of the temperature rise with respect to the screen grid shown in FIG. 6. The screen grid shown in FIG. 6 is installed in a position which is 0.35 mm apart from the energization heater embodying the present invention. Then, in the environment at the room temperature of 25° C., the energization heater is energized to maintain the surface temperature at 170° C. In this condition, the surface temperature of the screen grid is kept at 50° C. constantly. It is thus confirmed that the infrared radiation ratio is made effectively 0.1 or less. As a comparison in this respect, one sample screen grid is made by rolled stainless steel plate in the same configuration as the one shown in FIG. 6, but the surface of the screen grid is not processed to be glossy. This comparison grid is placed under the same environment. Then, when the surface temperature of the energization heater arrives at 170° C., the temperature of this sample screen grid is raised to 140° C. As a result, image unevenness takes place, and the problem of safety is encountered.

Now, the description will be made of the mechanism for preventing a recording paper sheet from being deformed (cockled) in accordance with the present embodiment.

When the energization heater that embodies the present invention is used in a position that faces a recording head, the moment aqueous ink adheres to the recording paper sheet, the deformation (cockling) of the recording paper sheet takes place. Usually, the ink jet recording head is installed with a gap of approximately 1 mm to the surface of the recording material. Then, if the cockling is excessive, the surface of the recording head and the recording material are in contact with each other, making it difficult to discharge ink normally in some cases. In accordance with the present embodiment, there is provided a guide that presses the recording paper sheet from above, while assisting the transfer thereof, in a position that faces the device for supporting the recording material in contact, but does not interfere with the operation of the recording head. It is preferable to form the guide with a flat plate in a configuration so as to press the entire width of the recording paper sheet. It is also preferable to configure the end portion of the guide with the edge having a number of waveforms provided with an opening angle in the traveling direction of the recording paper sheet rather than to make it a straight line. This is because, as in the screen grid described earlier, the recording paper sheet should not be caught by the guide, and also because with such configuration of the guide, the generation of irregular cockling should be suppressed.

Also, it may be possible to install another guide that pinches the recording paper sheet on each end in the width direction of the recording paper sheet in order to prevent it from being carried diagonally. In this case, however, the guide should be shiftable so as not to press the recording paper sheet too intensively. These arrangements are needed in order to avoid swelling of the recording paper sheet resulting from crinkling of the surface thereof. The material of the guide is not necessarily confined, but it is preferable to use the one whose infrared radiation ratio is 0.1 or less like the screen grid in consideration of the case where heating is given before the recording position (for example, if the structure is arranged as in the heating means D and B, it is possible to reduce the degree of cooling that may occur during the carrying period of the recording paper sheet that has been heated by heating means D to the recording position where heating means B is located). The specific example of the guide is shown in FIG. 8.

FIG. 8 shows the guide arranged in a position that faces the device that supports a recording material, which assists the transfer of the recording material. This guide is formed by SUS 304 whose plate thickness is 0.1 mm, and ground until the surface roughness thereof becomes 1.0 $\mu$m or less. The opening angle of the edge 97 of the guide is 45°.

Now, the description will be made of the temperature control of the energization heater installed in a position that faces a recording head.

Various recording media can be the object of an ink jet recording apparatus. It is required to obtain the best result of recording under any recording condition. The heating fixation is mainly aimed at allowing only the colorant of dyes contained in ink to remain on a recording paper sheet as much as possible.

The inventors hereof have found that by the combination of the amount of recording liquid to be given to a recording material per unit time (hereinafter referred to the ratio R of shooting amount of ink) together with the required electric power for heating, a specific temperature can be controlled and set appropriately, and that with such control, the best result of printing is obtainable under any recording condition. On the basis of such finding, the inventors hereof have established this combination as a method for controlling the temperature of an energization heater.

Now, given the resolution of a recording head as D (dpi); the number of nozzles of the recording head, as N; the driving frequency of the recording head, as F (Hz); the volume of ink droplets, as V (ml); the ratio of nozzles numbers that discharge ink at a time against the total number of nozzles, as n; all the ink discharged from the recording head, as water of T° C (water 1 ml=1 g, and evaporating heat of water as h), a condition is defined so that the moment discharge is made, ink adheres to a recording paper sheet, and that the moment ink adheres to the recording paper sheet, it is all transformed into vapor (here, the volume which is equivalent to thermal work is defined as J, and the heat efficient to ink, as $\eta$).

In this respect, the heat efficiency $\eta$ is defined by (absorbed energy)/(input energy). In accordance with the heating method adopted for the conventional ink jet recording apparatus, the absorbed energy is distributed to ink and paper sheet, and ink is heated by heat that has passed the paper sheet. Therefore, the rise of ink temperature $\leqq$ the temperature rise of the paper sheet. Hence, even if the input energy should all be absorbed into the heated object, it is estimated that the maximum heating efficiency on ink is 50%.

Now, (1) in the case of a serial printer, the ratio Rs of shooting amount of ink and the heating power Ws is obtained as follows:

$$Rs=N\times F\times V\times n \text{ (ml/sec)} \tag{1}$$

$$Ws=Rs\times[(100-T)+h]\times J/\eta(W) \tag{2}$$

The relationship T (Ws) between the heating power Ws and the surface temperature of the energization heater has been obtained separately, and then, recording should be performed in condition that the temperature Tr is determined uniquely by the ratio Rs of shooting amount of ink. As an example, given N=64, F=10 kHz, $4V=3\times10^{-8}$ml, n=1.0, T=25° C., $\eta$=0.5, the ratio Rs of shooting amount of ink= 0.0192 ml/sec. The heating power Ws=98.9 W.

(2) in the case of a full-line printer, if the recording width is defined as L (inch), the ratio Rs of shooting amount of ink and the heating power Ws is obtained as follows:

$$R_L=L\times D\times F\times V \text{ (ml/sec)} \tag{3}$$

$$W_L=RL\times[(100-T)+h]\times J/\eta(W) \tag{4}$$

As an example, given L=8, D=600, F=5 kHz, $V=2\times10^{-8}$ml, T=25° C., $\eta$=0.5, the ratio Rs of shooting amount of ink= 0.48 ml/sec. The heating power Ws=2471 W.

As in the case of the serial printer, the relationship $T(W_L)$ between the $W_L$ and the surface temperature of the energization heater should be obtained separately for the full-line printer, and recording should be performed in condition that the temperature Tr is determined uniquely by the $R_L$.

The above example of calculation is for an ordinary paper as a recording material. For the recording materials other than the ordinary paper, such as transparent film, coated paper, or glossy paper, which has different characteristics of ink absorption from those of the ordinary paper sheet, recording becomes better by setting the different temperatures for the heater. Therefore, the temperatures of the heater can be appropriately set in accordance with the materials of the recording media.

Ultimately, the temperature functions Tr are obtained for various ratios R of shooting amounts of ink. Further, the temperature designations are combined in accordance with the kinds of recording materials. Then, such information is stored in ROM or the like on the driving circuit of the energization heater as a table of control conditions. In this manner, it is made possible to perform recording in the best heating condition in accordance with a recording material and printing mode designated by means of the printer driver or the like installed in an ink jet recording apparatus.

Hereinafter, the description will be made of the experiments conducted to obtain specific heating conditions, as well as the contents of studies made on the results of the experiments.

For the execution of the experiments, an energization heater having electrical resistance of 15 Ω is incorporated in a printer BJC-610 (manufactured by Canon Inc.: provided with a recording head of 360 dpi, 64 nozzles; the amount of discharge, 30 pl; the driving frequency, 6 kHz; and water color ink used). The gap between the recording paper sheet and the energization heater is set at 0.35 mm. Power is supplied from a DC power source PMC-352A (manufactured by Kikusui Electronics, Inc.). Images are recorded all over an ordinary paper sheet (the ratio Rs of shooting amount of ink=0.01152 ml/sec). Then, the relationship between the quality of recorded images and the heating power is studied. As a result, the power dissipation is 24.8 W against the maximum power dissipation 59.3 W calculated by the formula (2) (provided that $\eta$=0.5). The enhancement of image quality is observed (such as suppression of spreading and bleeding, and improvement of optical concentration). The surface temperature of the energization heater at that time is 170° C.

In accordance with the conventional heat fixing means, heat is transferred to ink through a recording paper sheet that has been heated. Therefore, there is a need for giving heat excessively, and only in the heating condition where the solvent (water) in ink may be evaporated completely, is it possible to adequately enhance the image quality. However, the energization heater embodying the present invention has a higher heating efficiency on ink, and as compared with the conventional heater, it is possible to save energy more than 50%. For the heating fixation, although the behavior, in which ink that adheres to a recording paper is fixed, has not been made clear completely as yet, it is assumed that since color solvent generally has a lower thermal stability, colorant may be reduced by the application of heat and coagulated on the surface of the recording paper sheet, and that the coagulated substance is highly viscous so that its movability is smaller on the surface of the recording paper sheet, among some other factors.

The heat fixing means embodying the present invention has enhanced characteristics of infrared absorption with respect to ink of the recorded object. It is understandable that since the above-mentioned effect of this means is higher than that of the conventional one, it can improve the image quality with use of a smaller amount of energy. As a result, the heating fixation means of the present invention demonstrates a sufficient effect even without evaporating moisture completely, hence making it possible to design the unit of heating means compactly, and to make the printer smaller accordingly.

Also, the image quality can be enhanced sufficiently even without evaporating solvent (moisture) completely. Therefore, if an exhaust fan should be provided, it is still possible to minimize its structure for the effective use of the fan.

As the driving circuit of the energization heater, one example may be cited as shown in FIG. 9, which is represented in the form of a block diagram.

In FIG. 9, a reference numeral 10 designates an energization heater; 11, a power source; 12, a temperature control circuit; 13, a temperature controller; 14, temperature detection means; 15, a CPU for use of printer control; and 16, the safety device of the energization heater (which will be described later in detail). The power source 11 may be for an alternating current supply or for a direct current supply. However, it is preferable that the capacitance of the power source has a margin of approximately 10% to the maximum power dissipation.

The temperature control circuit 12 is the ROM that stores the temperature control conditions described above. On the ROM, there are stored not only the operational temperatures of the energization heater in recording, but also, such information as the heating conditions on the printing standby before a printing command is given; power information required for raising the heater to a given temperature when a printing command is issued; the control temperature between one recording paper sheet and another during a continuous recording; and information required for selecting heating means in a particular position, among some others. On the basis of such information, the CPU 15 performs the temperature control of the energization heaters.

Here, any type of temperature controller 13 can be adopted as long as the controller is able to turn on and off the load in accordance with the external signals.

Temperature detection means is to sense the surface temperatures of the energization heater. This means may be formed by a thermo couple, a thermistor, or the like.

Now, the description will be made of the operation of the heating fixation system shown in FIG. 9. At first, when image recording signals and information of a recording material are transferred to a printer from a PC (personal computer) or the like, the CPU 15 selects the optimum heating condition from the temperature control circuit (ROM) in according with the contents carried by the signals thus provided. In continuation, the CPU 15 supplies the required power from the power source 11 to the energization heater 10. In this respect, the On-Off control of the power source 11 is controlled through the temperature controller 13. The CPU 15 monitors the temperatures of the energization heater 10 in accordance with signals being transmitted from temperature detection means 14. When the temperature of the energization heater arrives at the one selected from the temperature control circuit 12, the CPU transmits the sheet feeding signal to a sheet carrier device (not shown), thus transferring the recording paper sheet to the recording region. Then, the CPU 15 transmits recording signals to the recording head (not shown) to start printing.

When the power source is turned on for the printer for the first time, the CPU 15 controls heating of the energization heater 10 in the warm air condition stored on the temperature control circuit 12. As the printer receives image recording signals in the idling state, which necessitates making the temperature rising time shorter, the CPU 12 also heats the energization heater in accordance with the information of power rising stored on the temperature control circuit 12. Then, when it is confirmed that the temperature of the heater has arrived at the predetermined one in accordance with signals from the temperature detection means, the CPU controls the ON-OFF of the power supply from the power source 11 to the energization heater 10 through the temperature controller 12, hence keeping the operational temperature constantly in recording. When recording is completed, the CPU 15 reads the warm air condition from the temperature control circuit 12 for determining whether the power required for the warm air operation should be supplied to the energization heater 10 or the power supply to the energization heater should be suspended.

Now, the description will be made of the safety device 16 shown in FIG. 9.

The heater has potentially the danger that if the control of the apparatus is disabled, the heater is caused to be runaway; the apparatus may be damaged by an abrupt rise in temperature caused by the thermal damage given to the recording paper sheet that may reside on the heater due to jamming of the recording paper sheet; or fire may break out in the worst case. To counteract such potential danger, the provision of a safety device is effectively adoptable. For the energization heater embodying the present invention, it is preferable to provide the heater itself with means for cutting off electric current or a mechanism to cut off electric current by means of an external circuit when the temperature rises to more than a specific temperature or a complex means having them together.

As means for cutting off electric current, which is provided for the energization heater itself, there is cited the one structured as shown in FIG. 10.

In FIG. 10, a temperature fuse 21 is arranged on a part of the resistor pattern 20 of the heater. The temperature fuse works when the heater temperature rises abruptly due to a disabled control. In order to make the response time as short as possible before the temperature fuse operates, a part of the temperature fuse is formed by a thick film to make the area of thermal sensitivity larger. In this respect, a reference numeral 22 designates an alumina substrate of the energization heater, and 23, electrodes for supplying electric power. Conventionally, a temperature fuse is used for the device that necessitates the supply of a large power for charging such device. Therefore, it is difficult to make the response time shorter before fusing the temperature fuse. Here, for the temperature fuse 21, it is preferable to use Sn, solder, or some other metal or an alloy having a lower fusion point. The fusion temperature is based on the maximum temperature adopted by the energization heater, and it is desirable to set the fusion temperature slightly higher than such maximum temperature.

FIG. 11 is a block diagram which shows the structure of the safety device installed outside the apparatus.

In FIG. 11, a reference numeral 24 designates an infrared photosensor; 25, a detection circuit; 26, a temperature controller; 27, SSR (solid state relay); 28, magnetic clutch; and 10, an energization heater.

Now, the operation of the present embodiment will be described. The detection circuit 25 transforms into voltage the electric current that runs through the infrared photosensor 24 which changes in proportion to the amount of light received. The temperature control unit 26 determines that the energization heater is in operation when the detected voltage is smaller than a specific value. If any abnormal rise of temperature takes place when the temperature control unit 26 recognizes the supply of electric power to the energization heater, such abnormal rise of temperature is sensed immediately by the infrared photosensor 24. The detection circuit 25 transfers the voltage higher than the normally detected voltage to the temperature control unit 26. Having received such voltage, the temperature control unit 26 operates as given below.

When the temperature control unit 26 receives a voltage higher than the normal detection voltage, this unit turns off the magnetic clutch 28 which is directly connected with the power supply line of the energization heater 10. The power supply to the energization heater 10 is then cut off to prevent it from being runaway.

Now, with reference to FIG. 12, the description will be made of an ink jet recording apparatus provided with each of the structures that have been described above.

In FIG. 12, a reference numeral 30 designates an energization heater installed in the position that faces a recording head 100. This heater has the infrared radiation characteristics indicated by the curved line in FIG. 1. The energization heater 30 is formed on an alumina substrate of 10 mm width, and 0.6 mm thick, having on it the AG—Pd resistor pattern and Si 55, Fe 18, Zr 15, Ti 8, and Mn (wt %) on such pattern. Its electric resistance is 15 Ω. The maximum power dissipation is 35 W. The energization heater can demonstrate the heat fixing effect up to the throughput of four A4-sized full color images per minute.

A reference numeral 32 designates a screen grid formed by SUS 304 whose plate thickness is 0.1 mm; 33, a guide formed by the same material as the screen grid 32; 34, paper sheet carrier means formed in the rubber roller configuration; 35, an auxiliary guide with star wheels that carries the recording paper sheet; and 36, a unit formed by the driving circuit and temperature control unit whose specific structures are the same as those shown in FIG. 9.

FIG. 13 is a cross-sectional view which shows the recording head 100, the energization heater 30, the screen grid 32, the guide 33, the rubber roller 34, and the star wheeled guide 35, and the relative positional relationship between them as well. In accordance with the present embodiment, there is a gap of 0.35 mm between the energization heater 30 and screen grid 31.

The ink jet recording apparatus embodying the present invention can demonstrate various effects as described above. The fundamental characteristics are such that heat is well absorbed by ink efficiently, while it is not easily absorbed by recording paper sheets, because the infrared radiation characteristics of the energization heater used therefor has its maximum value within a range of 4 to 10 $\mu$m. As an experiment to confirm such effects, an ordinary paper sheet is placed on the energization heater, and then, the temperature is raised to the one at which the color of the paper changes. However, no color change occurs in three minutes. After that, the recording paper sheet is left intact. Then, although its color changes, no burning or smoking takes place. Meanwhile, the same experiment is conducted on the energization heater having the conventional infrared radiation characteristics. Then, color change begins in 30 seconds. After that, as the recording paper sheet is left intact, smoking begins to present a dangerous state.

As described above, the recording apparatus of the present embodiment is provided with the sufficient safety measure in order to avoid the runaway of the energization heater, but the energization heater itself has a lower heating efficiency on paper. As a result, the safety of the apparatus is further improved.

(Embodiment 2)

FIG. 14 is a cross-sectional view which shows the structure of an ink jet recording apparatus in accordance with a second embodiment of the present invention.

The present embodiment is such that a sheet heater 37 is further installed in a position before recording in addition to the first embodiment shown in FIG. 12, and that the recording paper sheet is heated by this heater from the reverse side thereof. Any other structures of the present embodiment are the same as those of the embodiment shown in FIG. 12.

In accordance with the present embodiment, although the obtainable image quality is equal to that of the first embodiment, the preventive effect on the thermal deformation of the recording paper sheet is more enhanced than that of the first embodiment.

(Embodiment 3)

FIG. 15 is a cross-sectional view which shows the structure of an ink jet recording apparatus in accordance with a third embodiment of the present invention.

For the present embodiment, a halogen lamp heater 38 is installed in a position after recording in addition to the first embodiment shown in FIG. 12 in order to heat the recording paper sheet from the reverse side thereof.

In accordance with the present embodiment, although the obtainable image quality is equal to that of the first embodiment, the dryness of prints after recording is higher than that of the first embodiment. Also, the deformation thereof is smaller.

(Embodiment 4)

FIG. 16 is a cross-sectional view which shows the structure of an ink jet recording apparatus in accordance with a fourth embodiment of the present invention.

For the present embodiment, two energization heaters 39 and 40 are arranged in parallel with the same pattern as shown in FIG. 10, which are formed on an alumina substrate of 40 mm width and 0.6 mm thick as in the first embodiment shown in FIG. 12. The energization heater 39 is positioned to face the recording head 100. The energization heater 40 is positioned after recording and heats the recording paper sheet from the reverse side thereof. The other structures of the present embodiment are the same as those of the embodiment shown in FIG. 12.

In accordance with the present embodiment, the same effects as the third embodiment can be demonstrated, that is, the obtainable image quality is the same as that of the first embodiment, but the dryness of prints after recording is higher than that of the first embodiment. Also, the deformation thereof is smaller. In accordance with the present embodiment, it is possible to make the recording apparatus smaller than that of the third embodiment.

(Embodiment 5)

FIG. 17 is a cross-sectional view which shows the structure of an ink jet recording apparatus in accordance with a fifth embodiment of the present invention.

The present embodiment is such that a sheet heater 41 is in a position before recording to heat the recording paper sheet from the surface side thereof, and that an energization heater 42 having the same structure as that of the first embodiment is installed in a position that faces the recording head. Any other structures of the present embodiment are the same as those of the embodiment shown in FIG. 12.

In accordance with the present embodiment, although the obtainable image quality is equal to that of the first embodiment, the preventive effect on the thermal deformation of the recording paper sheet is more enhanced than that of the first embodiment.

(Embodiment 6)

FIG. 18 is a cross-sectional view which shows the structure of an ink jet recording apparatus in accordance with a sixth embodiment of the present invention.

For the present embodiment, a ceramic heater 46 is installed in a position after recording to heat the recording paper sheet from the surface thereof, and an energization heater 30 having the same structure as that of the first embodiment is installed in the position that faces the recording head. Any other structures are the same as those of the embodiment shown in FIG. 12.

In accordance with the present embodiment, although the obtainable image quality is equal to that of the first embodiment, the dryness of prints after recording is higher than that of the first embodiment when the ink whose permeability is smaller is used. Also, the prevention effect on the thermal deformation of the recording paper sheet is higher than that of the first embodiment.

(Embodiment 7)

FIG. 19 is a cross-sectional view which shows the structure of an ink jet recording apparatus in accordance with a seventh embodiment of the present invention.

For the present embodiment, two energization heaters 43 and 44 are arranged in parallel, each having the same structure as that of the first embodiment.

The energization heaters 43 and 44 are made a unit in a length larger than the width of an A1-sized recording sheet by 10 mm each on the left and right sides. The power dissipation of the energization heaters 43 and 44 is 300 W. Each of them can be controlled individually. A reference numeral 45 designated a screen grid for use with a larger sized sheet. In accordance with the present embodiment, it is possible to obtain a high quality recording of the larger-sized sheet, such as the A1 size, without creating any cockling and unevenness.

In accordance with the embodiments described above, the ink jet recording apparatus is capable of optimizing the characteristics of the infrared radiation given to the energization heaters, as well as optimizing the heating positions and temperature control thereof, in order to obtain recorded images in the best condition all the time. Therefore, the ink jet recording apparatus can demonstrate excellent heating fixation effects as given below with a high safety arrangement.

In other words, in accordance with the embodiments described above, the ink jet recording apparatus demonstrates such effects as to effectuate a high coloring without smaller amount of spread, and to suppress bleeding for the reduction of cockling. As a result, the quality of recorded images is enhanced.

Also, the power dissipation is lower to make the capacitance of the power supply smaller. Also, with the smaller numbers of attachments, such as reflection plate, the heater unit can be made smaller accordingly. Therefore, this heating fixation arrangement is applicable to a smaller sized printer for personal use.

Even when aqueous ink is used, the generation of vapors is smaller. Therefore, it is made possible to avoid damage due to vapor generation. Also, the apparatus can demonstrate good heating effects on aqueous ink, and non-aqueous ink as well.

What is claimed is:

1. An ink jet recording apparatus for recording by discharging recording liquid droplets from discharge openings to a recording material for the adhesion of said liquid droplets on said recording material for the formation of images, comprising:

a carrier path for carrying said recording material;

heating means arranged on said carrier path to heat said recording material and recording liquid, said heating means being provided with a heater that radiates infrared radiation having a maximum radiation ratio $\epsilon$ within a peak wavelength range of 4 to 10 $\mu$m, and a supporting member for supporting the recording material at a position where the recording material is heated by the heating means, and having a surface with an infrared radiation ratio of not more than 0.1.

2. An ink jet recording apparatus according to claim 1, wherein the heater is arranged in a position to heat said recording material and recording liquid from the reverse side of the recording surface of said recording material.

3. An ink jet recording apparatus according to claim 1, wherein the surface temperature of the heater for heating said recording material is the temperature set by the combination of the kind of the recording material and the amount of recording liquid provided for the recording material per unit time.

4. An ink jet recording apparatus according to claim 1, wherein the heating width heated by the heater is ½ or more than the recording width recorded by the recording head, and said heater is positioned in a location to enable ½ or more of said recording width to be overlapped with said heating width in projection.

5. An ink jet recording apparatus according to claim 1, wherein the heater is covered by a film containing two or more kinds of oxide elements selected from among the element group of Mg, Al, Si, Ti, Cr, Mn, Fe, Co, Ni, Cu, Zr.

6. An ink jet recording apparatus according to claim 1, wherein the heater is covered by an oxide film containing carbon and one or more kind of elements selected from among the element group of Mg, Al, Si, Ti, Cr, Mn, Fe, Co, Ni, Cu, Zr.

7. An ink jet recording apparatus according to claim 1, wherein the heater is provided with means for cutting off electric current to itself for heating when the temperature of the heater itself becomes more than a specific temperature.

8. An ink jet recording apparatus according to claim 1, wherein a cut off circuit is provided to cut off electric current to the heater for heating when the temperature of the heater becomes more than a specific temperature.

9. An ink jet recording apparatus according to claim 1, wherein the member supporting the recording material is a grid type flat plate provided with a number of apertures that open at an angle to the traveling direction of the recording material.

10. An ink jet recording apparatus according to claim 1, wherein a guide formed by a flat plate having a number of wavy edges that open at an angle in the moving direction of the recording material is arranged in a position to face the member supporting the recording material or assisting the conveyance of the recording material.

11. An ink jet recording apparatus according to claim 10, wherein the infrared radiation ratio $\epsilon$ of the guide is 0.1 or less.

12. An ink jet recording apparatus for recording by discharging recording liquid droplets from discharge openings to a recording material for the adhesion of said liquid droplets on said recording material for the formation of images, comprising:

a carrier path for carrying said recording material;

heating means arranged on said carrier path to heat said recording material and recording liquid, said heating means being provided with a first heater that radiates infrared radiation having a maximum radiation ratio $\epsilon$ within a peak wavelength range of 4 to 10 $\mu$m, a second heater having radiation characteristics different from said first heater, and a supporting member for supporting the recording material at a position where the recording material is heated by the first heater, and having a surface with an infrared radiation ratio of not more than 0.1, said first heater being in a position to face said recording head, and said second heater being in a position to heat said recording material before recording.

13. An ink jet recording apparatus according to claim 12, wherein the surface temperature of the heater for heating said recording material is the temperature set by the combination of the kind of the recording material and the amount of recording liquid provided for the recording material per unit time.

14. An ink jet recording apparatus according to claim 12, wherein the heating width heated by the heater is ½ or more than the recording width recorded by the recording head, and said heater is positioned in a location to enable ½ or more of said recording width to be overlapped with said heating width in projection.

15. An ink jet recording apparatus according to claim 12, wherein the heater is covered by a film containing two or more kinds of oxide elements selected from among the element group of Mg, Al, Si, Ti, Cr, Mn, Fe, Co, Ni, Cu, Zr.

16. An ink jet recording apparatus according to claim 12, wherein the heater is covered by an oxide film containing carbon and one or more kinds of elements selected from among the element group of Mg, Al, Si, Ti, Cr, Mn, Fe, Co, Ni, Cu, Zr.

17. An ink jet recording apparatus according to claim 12, wherein the heater is provided with means for cutting off electric current to itself for heating when the temperature of the heater itself becomes more than a specific temperature.

18. An ink jet recording apparatus according to claim 12, wherein a cut off circuit is provided to cut off electric current to the heater for heating when the temperature of the heater becomes more than a specific temperature.

19. An ink jet recording apparatus according to claim 12, wherein a guide formed by a flat plate having a number of wavy edges that open at an angle in the moving direction of the recording material is arranged in a position to face the member supporting the recording material or assisting the conveyance of the recording material.

20. An ink jet recording apparatus according to claim 19, wherein the infrared radiation ratio $\epsilon$ of the guide is 0.1 or less.

21. An ink jet recording apparatus according to claim 12, wherein the surface temperature of the first heater is more than the surface temperature of the second heater for heating the recording material before recording, and at the same time, each of the surface temperature of the first heater and the surface temperature of the second heater does not exceed the decomposition temperature causing deformation of the recording material.

22. An ink jet recording apparatus for recording by discharging recording liquid droplets from discharge openings to a recording material for the adhesion of said liquid droplets on said recording material for the formation of images, comprising:

a carrier path for carrying said recording material;

heating means arranged on said carrier path to heat said recording material and recording liquid, said heating means being provided with a first heater that radiates infrared radiation having a maximum radiation ratio $\epsilon$ within a peak wavelength range of 4 to 10 $\mu$m, a second heater having radiation characteristics different from said first heater, and a supporting member for supporting the recording material at a position where the recording material is heated by the first heater, and having a surface with an infrared radiation ratio of not more than 0.1, said first heater being in a position to face said recording head, and said second heater being in a position to heat said recording material after recording.

23. An ink jet recording apparatus according to claim 22, wherein the surface temperature of the heater for heating said recording material is the temperature set by the combination of the kind of the recording material and the amount of recording liquid provided for the recording material per unit time.

24. An ink jet recording apparatus according to claim 22, wherein the heating width heated by the heater is ½ or more than the recording width recorded by the recording head, and said heater is positioned in a location to enable ½ or more of said recording width to be overlapped with said heating width in projection.

25. An ink jet recording apparatus according to claim 22, wherein the heater is covered by a film containing two or more kinds of oxide elements selected from among the element group of Mg, Al, Si, Ti, Cr, Mn, Fe, Co, Ni, Cu, Zr.

26. An ink jet recording apparatus according to claim 22, wherein the heater is covered by an oxide film containing carbon and one or more kinds of elements selected from among the element group of Mg, Al, Si, Ti, Cr, Mn, Fe, Co, Ni, Cu, Zr.

27. An ink jet recording apparatus according to claim 22, wherein the heater is provided with means for cutting off electric current to itself for heating when the temperature of the heater itself becomes more than a specific temperature.

28. An ink jet recording apparatus according to claim 22, wherein a cut off circuit is provided to cut off electric current to the heater for heating when the temperature of the heater becomes more than a specific temperature.

29. An ink jet recording apparatus according to claim 22, wherein a guide formed by a flat plate having a number of wavy edges that open at an angle in the moving direction of the recording material is arranged in a position to face the member supporting the recording material or assisting the conveyance of the recording material.

30. An ink jet recording apparatus according to claim 29, wherein the infrared radiation ratio $\epsilon$ of the guide is 0.1 or less.

31. An ink jet recording apparatus according to claim 22, wherein the surface temperature of the first heater is more than the surface temperature of the second heater for heating the recording material before recording, and at the same time, each of the surface temperature of the first heater and the surface temperature of the second heater does not exceed the decomposition temperature causing deformation of the recording material.

32. An ink jet recording apparatus for recording by discharging recording liquid droplets from discharge openings to a recording material for the adhesion of said liquid droplets on said recording material for the formation of images, comprising:

a carrier path for carrying said recording material;

heating means arranged on said carrier path to heat said recording material and recording liquid, said heating means being provided with a first heater that radiates infrared radiation having a maximum radiation ratio $\epsilon$ within a peak wavelength range of 4 to 10 $\mu$m, a second heater having radiation characteristics different from said first heater, and a supporting member for supporting the recording material at a position where the recording material is heated by the first heater, and having a surface with an infrared radiation ratio of not more than 0.1, said first heater being in a position to face said recording head, and said second heater being in positions to heat said recording material before and after recording.

33. An ink jet recording apparatus according to claim 32, wherein the surface temperature of the heater for heating said recording material is the temperature set by the combination of the kind of the recording material and the amount of recording liquid provided for the recording material per unit time.

34. An ink jet recording apparatus according to claim 32, wherein the heating width heated by the heater is ½ or more than the recording width recorded by the recording head, and said heater is positioned in a location to enable ½ or more of said recording width to be overlapped with said heating width in projection.

35. An ink jet recording apparatus according to claim 32, wherein the heater is covered by a film containing two or more kinds of oxide elements selected from among the element group of Mg, Al, Si, Ti, Cr, Mn, Fe, Co, Ni, Cu, Zr.

36. An ink jet recording apparatus according to claim 32, wherein the heater is covered by an oxide film containing carbon and one or more kinds of elements selected from among the element group of Mg, Al, Si, Ti, Cr, Mn, Fe, Co, Ni, Cu, Zr.

37. An ink jet recording apparatus according to claim 32, wherein the heater is provided with means for cutting off electric current to itself for heating when the temperature of the heater itself becomes more than a specific temperature.

38. An ink jet recording apparatus according to claim 32, wherein a cut off circuit is provided to cut off electric current to the heater for heating when the temperature of the heater becomes more than a specific temperature.

39. An ink jet recording apparatus according to claim 32, wherein a guide formed by a flat plate having a number of wavy edges that open at an angle in the moving direction of the recording material is arranged in a position to face the member supporting the recording material or assisting the conveyance of the recording material.

40. An ink jet recording apparatus according to claim 39, wherein the infrared radiation ratio $\epsilon$ of the guide is 0.1 or less.

41. An ink jet recording apparatus according to claim 32, wherein the surface temperature of the first heater is more than the surface temperature of the second heater for heating the recording material before recording, and at the same time, each of the surface temperature of the first heater and the surface temperature of the second heater does not exceed the decomposition temperature causing deformation of the recording material.

42. An ink jet recording apparatus for forming an image, with a recording head for discharging a recording liquid droplet from a discharge port, by depositing the recording liquid droplet on a sheet material, said apparatus comprising:

a conveyance route in which a sheet material is conveyed; and heating means provided in said conveyance route to heat said recording liquid droplet through the sheet material from a side opposite to a side of the sheet material deposited with the recording liquid droplet, said heating means being provided with a heating element that radiates infrared radiation having a maximum radiation ratio $\epsilon$ within a peak wavelength range of 5 $\mu$m to less than 7.5 $\mu$m, and further comprising a supporting member for supporting the sheet material at a position where the sheet material is heated by the heating means, and having a surface with an infrared radiation ratio of not more than 0.1.

43. An ink jet recording apparatus according to claim 42, wherein the heating means is arranged in a position to heat said sheet material and recording liquid from the reverse side of the recording surface of said sheet material.

44. An ink jet recording apparatus according to claim 42, wherein the surface temperature of the heating means for heating said sheet material is the temperature set by the combination of the kind of the sheet material and the amount of recording liquid provided for the sheet material per unit time.

45. An ink jet recording apparatus according to claim 42, wherein the heating width heated by the heating means is ½ or more than the recording width recorded by the recording head, and said heating means is positioned in a location to enable ½ or more of said recording width to be overlapped with said heating width in projection.

46. An ink jet recording apparatus according to claim 42, wherein the heating means is covered by a film containing two or more kinds of oxide elements selected from among the element group of Mg, Al, Si, Ti Cr, Mn, Fe, Co, Ni, Cu, Zr.

47. An ink jet recording apparatus according to claim 42, wherein the heating means is covered by an oxide film containing carbon and one or more kinds of elements selected from among the element group of Mg, Al, Si, Ti, Cr, Mn, Fe, Co, Ni, Cu, Zr.

48. An ink jet recording apparatus according to claim 42, wherein the heating means is provided with means for cutting off electric current to itself for heating when the temperature of the heating means itself becomes more than a specific temperature.

49. An ink jet recording apparatus according to claim 42, wherein a cut off circuit is provided to cut off electric current to the heating means for heating when the temperature of the heating means becomes more than a specific temperature.

50. An ink jet recording apparatus according to claim 42, wherein the member supporting the sheet material is a grid type flat plate provided with a number of apertures that open at an angle to the traveling direction of the sheet material.

51. An ink jet recording apparatus according to claim 42, wherein a guide formed by a flat plate having a number of wavy edges that open at an angle in the moving direction of the sheet material is arranged in a position to face the member supporting the sheet material or assisting the conveyance of the sheet material.

52. An ink jet recording apparatus according to claim 51, wherein the infrared radiation ratio $\epsilon$ of the guide is 0.1 or less.

53. An ink jet recording apparatus according to claim 42, wherein said heating means is provided with a heater arranged in a position to face said recording head.

54. An ink jet recording apparatus according to claim 53, wherein the surface temperature of the heater for heating said sheet material is the temperature set by the combination of the kind of the sheet material and the amount of recording liquid provided for the sheet material per unit time.

55. An ink jet recording apparatus according to claim 53, wherein the heating width heated by the heater is ½ or more than the recording width recorded by the recording head, and said heater is positioned in a location to enable ½ or more of said recording width to be overlapped with said heating width in projection.

56. An ink jet recording apparatus according to claim 53, wherein the heater is covered by a film containing two or more kinds of oxide elements selected from among the element group of Mg, Al, Si, Ti, Cr, Mn, Fe, Co, Ni, Cu, Zr.

57. An ink jet recording apparatus according to claim 53, wherein the heater is covered by an oxide film containing carbon and one or more kinds of elements selected from among the element group of Mg, Al, Si, Ti, Cr, Mn, Fe, Co, Ni, Cu, Zr.

58. An ink jet recording apparatus according to claim 53, wherein the heater is provided with means for cutting off electric current to itself for heating when the temperature of the heater itself becomes more than a specific temperature.

59. An ink jet recording apparatus according to claim 53, wherein a cut off circuit is provided to cut off electric current to the heater for heating when the temperature of the heater becomes more than a specific temperature.

60. An ink jet recording apparatus according to claim 42, wherein the recording liquid droplet is an aqueous ink having an infrared ray absorption spectrum exhibiting a main absorption peak at around 6.3 $\mu$m.

61. An ink jet recording apparatus according to claim 42, wherein the recording liquid droplet is a non-aqueous ink having an infrared ray absorption spectrum exhibiting a main absorption peak at around 5.8 $\mu$m.

62. An ink jet recording method for forming images by discharging recording liquid droplets from discharge openings to a recording material, comprising the steps of:

forming images by the adhesion of said recording liquid droplets to said recording material; and heating said recording material and said recording liquid droplets using infrared radiation having a maximum radiation ratio $\epsilon$ within a peak wavelength range of 4 to 10 $\mu$m, and supporting the recording material with a supporting member at a position where the recording material is heated, the supporting member having a surface with an infrared radiation ratio of not more than 0.1.

63. An ink jet recording method for forming an image using a recording apparatus comprising a recording head for discharging a recording liquid droplet from a discharge port, comprising the steps of:

depositing the recording liquid droplet on a sheet material, and heating said recording liquid droplet through the sheet material from a side opposite a side of the sheet material deposited with the recording liquid droplet, using infrared radiation having a maximum radiation ratio $\epsilon$ within a peak wavelength range of 5 $\mu$m to less than 7.5 $\mu$m, wherein said recording apparatus further comprises a supporting member for supporting the sheet material at a position where the sheet material is heated, and having a surface with an infrared radiation ratio of not more than 0.1.

* * * * *

UNITED STATES PATENT AND TRADEMARK OFFICE

CERTIFICATE OF CORRECTION

PATENT NO. : 6,244,700 B1
DATED : June 12, 2001
INVENTOR(S) : Isao Kimura et al.

It is certified that error appears in the above-identified patent and that said Letters Patent is hereby corrected as shown below:

Title page,
Item [54], ABSTRACT,
Line 5, “and” should read -- and a --.

Column 4,
Line 30, “e” should read -- ε --.

Column 5,
Line 1, “FIG .4” should read -- FIG. 4 --.

Column 6,
Line 12, “4 A” should read -- 4A --.

Column 8,
Line 2, “and,” should read -- and --.

Column 10,
Line 33, “satisfies·the” should read -- satisfies the --; and
Line 66, “speeds;” should read -- speeds, --.

Column 11,
Line 31, “-½ dh<Ic” should read -- ½ dh≤Ic --;
Line 32, “dp>dh>½ dp,” should read -- dp>dh≥½ dp, --;
Line 33, “0<dh<½” should read -- 0<dh≤½ --; and
Line 51, “in” should read -- in the --.

Column 12,
Line 7, “temperature” should read -- temperature, --; and
Line 19, “necessary” should read -- necessarily --.

Column 14,
Line 12, “nozzles” should read -- the number of nozzles --; and
Line 13, “numbers” should be deleted.

Column 16,
Line 42, “according” should read -- accordance --.

UNITED STATES PATENT AND TRADEMARK OFFICE

CERTIFICATE OF CORRECTION

PATENT NO. : 6,244,700 B1
DATED : June 12, 2001
INVENTOR(S) : Isao Kimura et al.

It is certified that error appears in the above-identified patent and that said Letters Patent is hereby corrected as shown below:

Column 20,
Line 21, “designated” should read -- designates --.

Column 21,
Lines 1-5, close up all margins; and
Line 24, “kind” should read -- kinds --.

Column 25,
Line 22, “Ti” should read -- Ti, --.

Signed and Sealed this

Thirteenth Day of August, 2002

*Attest:*

*Attesting Officer*

JAMES E. ROGAN
*Director of the United States Patent and Trademark Office*